US007026610B2

(12) United States Patent
Kato

(10) Patent No.: US 7,026,610 B2
(45) Date of Patent: Apr. 11, 2006

(54) MASS SPECTROMETER SYSTEM

(75) Inventor: Yoshiaki Kato, Mito (JP)

(73) Assignee: Hitachi High-Technologies Corporation, (JP)

( * ) Notice: Subject to any disclaimer, the term of this patent is extended or adjusted under 35 U.S.C. 154(b) by 37 days.

(21) Appl. No.: 10/895,132

(22) Filed: Jul. 21, 2004

(65) Prior Publication Data

US 2004/0262511 A1 Dec. 30, 2004

Related U.S. Application Data

(63) Continuation of application No. 10/679,454, filed on Oct. 7, 2003, now Pat. No. 6,828,551, which is a continuation of application No. 10/252,547, filed on Sep. 24, 2002, now Pat. No. 6,737,641.

(30) Foreign Application Priority Data

Feb. 20, 2002 (JP) ..... 2002-42511

(51) Int. Cl.
*H01J 49/04* (2006.01)

(52) U.S. Cl. ..... 250/285; 250/288; 250/281

(58) Field of Classification Search ..... 250/282, 250/281, 288, 285
See application file for complete search history.

(56) References Cited

U.S. PATENT DOCUMENTS

| | | | | |
|---|---|---|---|---|
| 6,469,297 | B1 * | 10/2002 | Kato | 250/288 |
| 6,541,768 | B1 | 4/2003 | Andrien et al. | |
| 6,583,409 | B1 * | 6/2003 | Kato | 250/288 |
| 6,596,989 | B1 * | 7/2003 | Kato | 250/288 |
| 2002/0036263 | A1 | 3/2002 | Shiokawa et al. | |
| 2002/0096631 | A1 | 7/2002 | Andrien et al. | |

FOREIGN PATENT DOCUMENTS

| | | |
|---|---|---|
| JP | 09-292368 | 11/1997 |
| JP | 2002-063865 | 2/2002 |

OTHER PUBLICATIONS

"A New Approach for the Study of Gas-Phase Ion—Ion Reactions Using Electrospray Ionization" Rachel R. Ogorzalek Loo, et al., 1992 American Society for Mass Spectrometry.

Stephenson, Jr., et al., " Ion/Ion Proton Transfer Reactions for Protein Mixture Analysis", Analytical Chemistry, vol. 68, No. 22, Nov. 15, 1996, pp. 4026-4032.

Stephenson, Jr., et al., " Adaptation of the Paul Trap for Study of the Reaction of Multiply Charged Cations with Singly Charged Anions" International Journal of Mass Spectometry and Ion Processes vol. 162, pp. 89-106 (1997).

* cited by examiner

*Primary Examiner*—Kiet T. Nguyen
(74) *Attorney, Agent, or Firm*—Dickstein Shapiro Morin & Oshinsky LLP

(57) ABSTRACT

There is provided an analyzer system capable of easily improving the efficiency of a charge reduction due to ion/ion reactions. A mass spectrometer system includes: a first ion source for ionizing a sample to be measured; a second ion source for producing ions of a polarity reversed from that of the ions produced in said first ion source; an ion deflector for introducing and deflecting the ions of said first and second ion sources; an ion-trap mass spectrometer including a ring electrode and a pair of endcap electrodes; and a detector for detecting the ions ejected from the mass spectrometer, wherein the ions from said first and second ion sources are introduced together through the ion deflector into the ion-trap mass spectrometer; the ions from the two ion sources are mixed in the ion-trap mass spectrometer; and in that the ions are then detected in the detector. Reactant ions can be sufficiently supplied to improve the efficiency of the charge reduction due to the ion/ion reactions

4 Claims, 20 Drawing Sheets

POST ION/ION REACTION MS/MS DATA

MASS SPECTROMETER SYSTEM

This application is a continuation of application Ser. No. 10/679,454, filed on Oct. 7, 2003 now U.S. Pat. No. 6,828,551, which is a continuation of application Ser. No. 10/252,547, filed on Sep. 24, 2002, now U.S. Pat. No. 6,737,641, which are hereby incorporated by reference in their entirety.

BACKGROUND OF THE INVENTION

1. Field of the Invention

The present invention relates to a mass spectrometer system for the mass spectrometry of a sample solution by ionizing the solution.

More particularly, the present invention relates to a mass spectrometer system capable of easily analyzing the mass spectrum of product ions complicated by multiply-charged ions.

2. Description of Related Art

The mass spectrometer is a system for measuring the mass of a substance directly in high sensitivity and precision. Therefore, the mass spectrometer is employed in a wide field from the astrophysics to the biotechnology.

In the mass spectrometer, there are many systems having different measuring principles. Of these, a quadrupole mass spectrometer (QMS) and an ion-trap mass spectrometer have spread into many fields because they have many functions even with a small size. The quadrupole mass spectrometer and the ion-trap mass spectrometer were invented by Dr. Paul in nineteen fifties, and its fundamental concept is disclosed in U.S. Pat. No. 2,939,952.

After this, many researchers or makers have made improvements in the system and method on the QMS and the ion-trap mass spectrometer. For example, the fundamental method for acquiring the mass spectrum by the ion-trap mass spectrometer is disclosed in U.S. Pat. No. 4,540,884. In U.S. Pat. No. 4,736,101, moreover, there is disclosed a method for detecting ions by applying a supplementary AC voltage to eject the ions resonantly. It has also been disclosed the resolution and the sensitivity are drastically improved by introducing a He gas of a pressure of about 1 mTorr ($10^{-3}$ Torr) into an ion-trap volume.

In recent years, an ionization technique such as the matrix-assisted laser desorption ionization (MALDI) or the electrospray ionization (ESI) has been developed for the mass spectrometry of biological high molecules of protein or DNA. Especially, the ESI is an ionization method capable of extracting the thermo-labile biological high molecules as stable ions of gas phase directly from the liquid phase.

In the ESI, the biological high molecules such as protein, peptide digested from the protein or DNA give multiply-charged ions having many charges. These multiply-charged ions are ions having a plurality of charges (of n-valences) in one molecule (m). The mass spectrometer (MS) performs the mass spectrometry of the ions having the mass m and the valences n as ions having a mass-to-charge ratio m/n. When a protein having a mass of 30,000 gives multiply-charged ions of 30 valences, for example, the m/z of the multiply-charged ions is m/z=30,000/30=1,000 so that they can be subjected to the mass spectrometry like the single-charged ions having the mass of 1,000.

Most proteins and peptides give positive multiply-charged ions, and the DNA gives negative multiply-charged ions. Therefore, even a small-sized mass spectrometer such as the quadrupole mass spectrometer (QMS) or the ion-trap mass spectrometer can measure proteins or DNA having a molecular weight over 10,000 easily.

When an extremely trace component in blood or living organism is to be analyzed, a pretreatment or cleanup for clearing many interferences (or impurities) are required before the mass spectrometry. This pretreatment or cleanup take a long time and a large manpower. Even with this complicated pretreatment, however, it is difficult to clear the impurities. These impurities are superposed over the signals of the biological sample components on the mass spectrum. These interferences are called the "chemical noises".

In order to remove or separate the impurities, there has been developed the liquid chromatograph/mass spectrometer (LC/MS) in which the liquid chromatograph (LC) is coupled to the upstream of the mass spectrometer (MS). FIG. 19 is a schematic diagram of the LC/MS of the prior art. A mobile phase solvent 101 of an LC 100 is delivered by an LC pump 102, and a sample solution is injected from an injector 103 into the mobile phase solvent. The sample solution is introduced into an analytical column 104 so that it is separated into living sample components to be analyzed. The sample components are introduced online into the ESI probe 1 of an ESI ion source 2 and are delivered to the tip portion of the ESI probe 1, to which a high voltage is applied. The sample solution is changed into extremely fine charged droplets (of microns) from the probe tip and is nebulized into the atmosphere by the action of the high electric field established near the tip of the ESI probe 1. These charged particles are mechanically pulverized to finer sizes by the collisions against the atmosphere molecules in the ESI ion source 2. After repeating these miniaturizations of particles, ions 3 are finally ejected into the atmosphere. This is the process of electrospray ionization (ESI). These ions are introduced into the mass spectrometer which has been evacuated by a plurality of vacuum pumps 105, 106 and 107. The ions introduced are further introduced through an intermediate pressure region 24 and an rf multipole ion guide 31 placed in a vacuum region 108, into a mass spectrometer 110 placed in the high vacuum region 108. The ions introduced into the mass spectrometer 110 are mass-analyzed and detected by a detector 16. The results are given as a mass spectrum by a data processor 19.

In the analysis of the biological components in the blood or biological organism, the highly sensitive measurement of extremely trace components cannot be easily achieved even with the assist of the pretreatment, the cleanup or the liquid chromatograph (LC). This is because the object sample to be analyzed is so extremely trace (pg=$10^{-12}$ g or less) in most cases that the interferences are far more than the components to be analyzed thereby to make it impossible to eliminate the interferences superposed over the sample components, sufficiently even by the pretreatment or the liquid chromatography (LC).

One solution for discriminating the chemical noises and the components to be analyzed is disclosed on 4026 to 4032 of Analytical Chemistry Vol. 68 (1996) by McLuckey and others, or on 89 to 106 of International Journal of Mass Spectrometry and Ion processes Vol. 162. This disclosure is a trial for discriminating the interferences (or chemical noises), the impurity components and the components to be analyzed, by means of the mass spectrometer. In the case of the LC/MS analysis of the living organism sample, most of the interferences are derived from molecules of a relatively small molecular weight of 1,000 or less, such as a solvent, salt, lipid or carbohydrate. These interferences are superposed over the mass spectrum of the biological high molecules of a molecular weight of 2,000 or more such as protein, peptide or DNA. This is because the biological high molecules give multiply-charged ions so that the mass peaks appear in a low mass region. In the ionization of the ESI, most of the interferences of a relatively low molecular weight give single-charged ions. On the other hand, the most of the biological high molecules such as protein or peptide give the multiply-charged ions.

McLuckey and others have tried to discriminate the single-charged chemical noise ions and the multiply-charged sample ions by utilizing the difference in their charge numbers. FIG. 18 shows a schematic diagram showing the system used by McLuckey and others (on P89 to P106 of International Journal of Mass Spectrometry and Ion Processes Vol. 162 (1997)). The biological sample solution is delivered to the ESI probe 1, to which the high voltage is applied, so that it is nebulized into ions in the volume of the ESI ion source 2. The positive ions 3 produced are introduced through an aperture 4 formed in the vacuum partition 5, into the intermediate pressure region 24 evacuated by the vacuum pump. An ion beam 6 is further introduced into a high-vacuum region 25 in which the ion-trap mass spectrometer is arranged. The ions are focused by a lens 9 and are introduced into an ion-trap volume 29 from an aperture 12 formed in an endcap electrode 11 of the ion-trap mass spectrometer. An aperture 8 having a diameter of 3 mm is formed in a ring electrode 13 of the ion-trap mass spectrometer. The gas of fluorocarbon fluoride reserved in a gas reservoir 23 is delivered to a glow discharge ion source 26. A negative high voltage is applied to the electrode 21 of the glow discharge ion source 26. The fluorocarbon gas produces negative ions by the glow discharge in the glow discharge ion source 26. The negative ions produced are introduced into the high vacuum region 25 and focused by a lens 27 so that they are introduced through the aperture 8 formed in the ring electrode 13 into the ion-trap volume 29 of the ion-trap mass spectrometer. By the main rf voltage applied to the ring electrode 13, an rf quadrupole field is established in the ion-trap volume 29. The positive multiply-charged ions produced by the ESI and the negative ions produced by the glow discharge are stably trapped by the rf quadrupole field which is established in the ion-trap volume 29.

Under a pressure of about 1 mTorr ($10^{-3}$ Torr), the single-charged negative ions and the positive multiply-charged ions are confined together in the ion-trap volume 29, to which the main rf voltage is applied. Then, the ions attract each other by the Coulomb attraction so that ion/ion reactions occur. As the ion/ion reactions, there have been reported a variety of reactions, of which the proton moving reactions play an important role. If the proton affinity (PA) of the negative ions exceeds that of the multiply-charged ions at the ion/ion reactions, the negative ions $A^-$ extract the protons $H^+$ from the n-valent multiply-charged ions $(m+nH)^{n+}$, as expressed by Formula (1), to give the multiply-charged ions $\{m+(n-1)H\}(n+1)+$ having a charge number less by 1.

$$(m+n)^{n+}+A^- \rightarrow \{m+(n-1)H\}^{(n-1)+}+AH \quad (1).$$

The multiply-charged ions have a high Coulomb attraction so that they cause the ion/ion reactions easily to give the protons easily to the negative ions. As the charges of the multiply-charged ions reduce, on the other hand, the Coulomb attractions of the ions become lower to cause the ion-molecular reactions relatively hardly. In short, the single-charged ions are reluctant to cause the charge reduction, but the multiply-charged ions are liable to cause the charge reduction.

Now, it is assumed that the n-valent multiply-charged ions are caused to reduce the charges by the ion/ion reactions with the single-charged negative ions thereby to produce the (n−1)-valent positive multiply-charged ions. In Formula (1), the mass of hydrogen is 1 (H=1) so that the change in m/z of the multiply-charged ions is expressed by Formula (2). The lefthand side indicates the m/z before the ion/ion reactions, and the righthand side indicates the m/z after the ion/ion reactions.

$$(m+n)/n \rightarrow (m+n-1)/(n-1) \quad (2).$$

Formula (2) is changed to the following so that it can be expressed as Formula (4):

$$m/n+1 \rightarrow m/(n-1)+1 \quad (3).$$

$$m/n \rightarrow m/(n-1) \quad (4).$$

The change Δ in m/z of the multiply-charged ions before and after the ion/ion reactions is expressed by the following Formula:

$$\Delta = m/n - m/(n-1) = -m/\{n(n-1)\} < 0 \quad (5).$$

Here, all of m, n and n−1 are positive integers so that Formula (6) is derived:

$$m/n < m/(n-1) \quad (6).$$

Specifically, the m/z of the multiply-charged ions having their charges reduced by the ion/ion reactions is larger than the m/z before the ion/ion reactions.

On the other hand, the single-charged ions hardly cause the ion/ion reactions so that they are left at the original position of m/z on the mass spectrum. Moreover, the single-charged ions having caused the ion/ion reactions lose the charges and become neutral so that they do not become the target of the mass spectrometry but are evacuated by the vacuum pump. As a result, the difference in the mass region between the multiply-charged ions having reduced the charges and moved to a high mass region and the chemical noises is enlarged to facilitate their discrimination.

McLuckey and others have improved this method and proposed the use of the charge reduction due to the ion/ion reactions so as to simplify the mass spectrum of the multiply-charged product ions produced after the MS/MS (on P899-P907 of Analytical Chemistry, Vol. 72 (2000) of McLuckey).

The charge reduction due to the ion/ion reactions makes it clear to discriminate the multiply-charged ions of a large mass from the chemical noises of a low mass region. In case the sample is a mixture, on the other hand, the m/z of the impurity ions is separated from the m/z of the sample molecules to discriminate those ions easily.

According to the aforementioned charge reduction due to the ion/ion reactions in the ion trap, as disclosed by McLuckey and others, it is possible to discriminate the chemical noises and the mass spectrum signal of the multiply-charged ions.

After a long time of the ion/ion reactions, the charges of the multiply-charged ions reduce so that the mass peaks shift to a higher mass region. Finally, the mass range of the mass spectrometer is exceeded. With this excess, the measurements cannot be done so that the reactions have to be controlled according to the ion quantities of the positive and negative ions. The progress of the reactions between the positive multiply-charged ions and the negative ions can be controlled with the time period for introducing the negative ions. For a longer reaction time, the charge reduction progresses so that the reactions are stopped when the single-charged ions finally become the neutral molecules.

In the structure shown in FIG. 18, the negative ions are introduced through the aperture 8 which is formed in the ring electrode 13 of the ion-trap-mass spectrometer. However, the rf voltage is applied to the ring electrode 13 so that the ion quantity to pass through the aperture 8 formed in the ring electrode 13 is reduced to 1/100 or less than that of the case in which the ions are introduced through the aperture 12 formed on the center axis on the side of the endcap. The shortage of the negative ions elongates the introduction time period and the ion/ion reaction time thereby to invite a subsidiary reaction or a loss of the multiply-charged ions in the ion trap.

By the aperture 18 having a diameter of 3 mm and formed in the ring electrode 13, moreover, the rf quadrupole field in the ion-trap volume 29 is distorted to deteriorate the resolution or sensitivity, which is the most important for the ion-trap mass spectrometer.

In the case of the ion-trap mass spectrometer, moreover, the introduction of a He gas (or a buffer gas) of a pressure of 1 mTorr ($10^{-3}$ Torr) into the ion-trap volume is essential for keeping the performance of the mass spectrometer. The large aperture 8 formed in the ring electrode 13 makes it difficult to keep the ion-trap volume at 1 mTorr while keeping the surrounding atmosphere of the ion-trap electrode at a high vacuum ($<10^5$ Torr). This difficulty damages the performance of the ion-trap mass spectrometer.

There are still left a number of problems including the problem that it takes many troubles and a long time to switch the polarity of the reactant ions, as accompanying the switching of the polarity of the ionization mode, or to switch the reactant ion species.

Moreover, the mass spectrometer, to which the ion/ion reactions are applied in the prior art, is only an ion-storage type mass spectrometer, i.e., the ion-trap mass spectrometer. The small-sized mass spectrometer such as the ion-trap mass spectrometer has a limited mass range to be measured, so that the biological high molecules such as protein or DNA can be measured only because they are multiply-charged ions. If the ion/ion reactions are utilized to eliminate the superposition of the mass spectrum over the chemical noises, the biological high molecules go out of measuring range so that they cannot be measured.

SUMMARY OF THE INVENTION

The present invention has been conceived to solve such problems and has an object to provide a mass spectrometer system capable of easily improving the efficiency of a charge reduction due to ion/ion reactions and applying the ion/ion reactions even if it utilizes a variety of mass spectrometers.

The present invention for the aforementioned object is to provide a mass spectrometer system for mass spectrometry of a sample to be measured, by ionizing the sample, comprising: a first ion source for ionizing the sample; a second ion source for producing ions of a polarity reversed from that of the ions produced in said first ion source; an ion deflector for introducing and deflecting the ions of said first and second ion sources; an ion-trap mass spectrometer including a ring electrode and a pair of endcap electrodes; and a detector for detecting the ions ejected from said mass spectrometer. The mass spectrometer system is characterized: in that the ions from said first and second ion sources are introduced together through said ion deflector into said ion-trap mass spectrometer; in that the ions from the two ion sources are mixed in said ion-trap mass spectrometer; and in that the ions are then detected in said detector.

There is also provided a mass spectrometer system for mass spectrometry of a sample to be measured, by ionizing the sample, comprising: a first ion source for ionizing the sample; a second ion source for producing ions of a polarity reversed from that of the ions produced in said first ion source; an ion deflector for introducing and deflecting the ions of said first and second ion sources; a mass spectrometer for mass spectrometry of the ions; and a detector for detecting the ions ejected from said mass spectrometer. The mass spectrometer system is characterized: in that the ions coming from said first and second ion sources are mixed between said first and second ion sources and said mass spectrometer; and in that the mixed ions are then introduced for the mass spectrometry into said mass spectrometer.

There is further provided a mass spectrometer system for mass spectrometry of a sample to be measured, by ionizing the sample, comprising: a first ion source for ionizing the sample; a second ion source for producing ions of a polarity reversed from that of the ions produced in said first ion source; a quadrupole mass spectrometer for the mass spectrometry of the ions coming from said first ion source; an rf multipole ion guide for producing product ions of the ions ejected from said quadrupole mass spectrometer; an ion deflector for introducing and deflecting the ions coming from said rf multipole ion guide and said second ion sources; a mass spectrometer for the mass spectrometry of the ions ejected from said ion deflector; and a detector for detecting the ions ejected from said mass spectrometer. The mass spectrometer system is characterized in that the ions from said first ion source and the ions from said second ion source are caused to collide in said rf multipole ion guide.

DESCRIPTION OF THE PREFERRED EMBODIMENTS

Here will be described the embodiments of the present invention. For simplicity of this description, the multiply-charged ions of a sample have a positive polarity, and the reactant ions have a negative polarity. In case the multiply-charged ions of a sample are negative, the measurement is done for the positive reactant ions.

Embodiment 1

Figure 1:
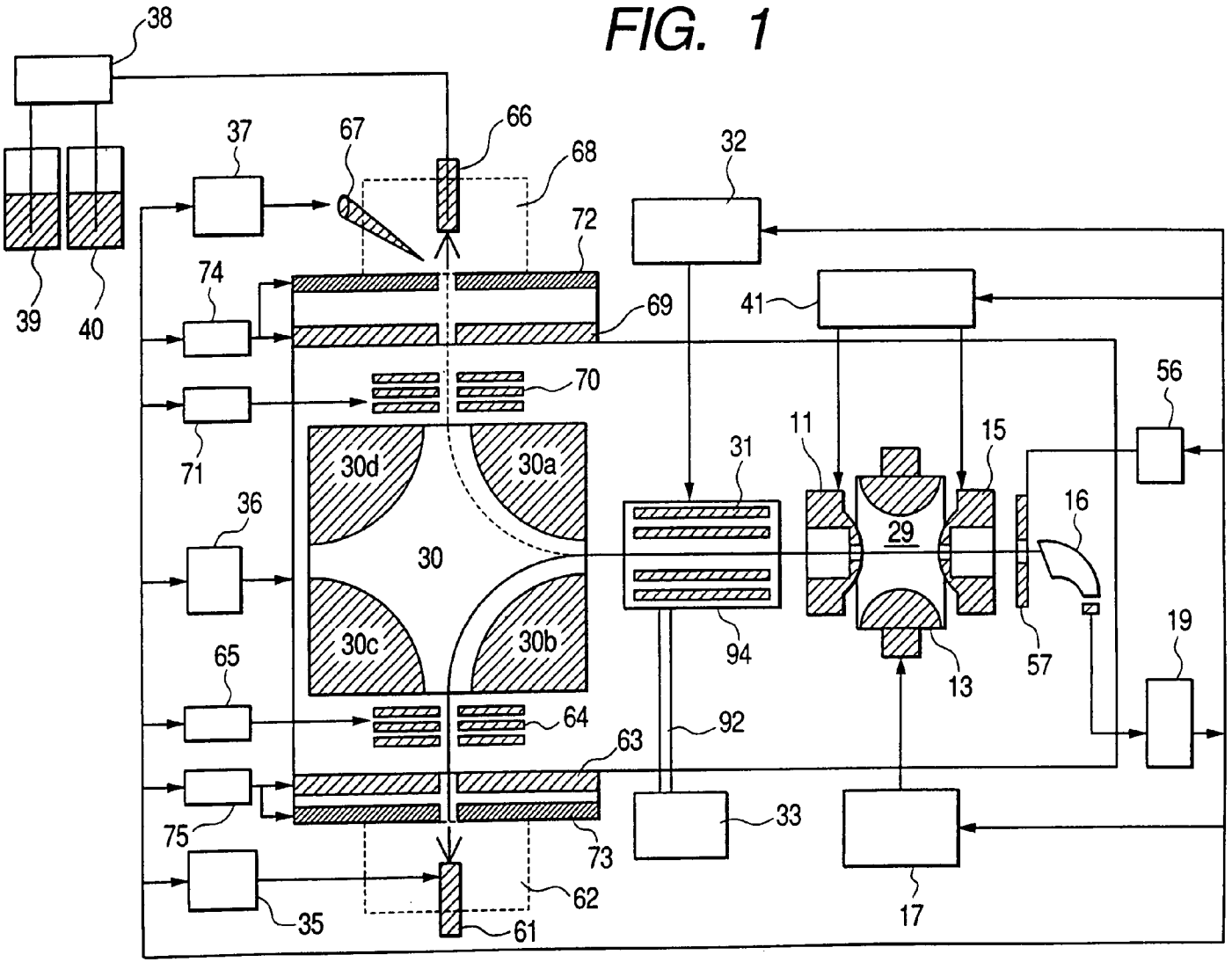
FIG. 1 is a schematic diagram of Embodiment 1.

FIG. 1 shows a system construction diagram of the present embodiment.

A sample solution delivered from a liquid chromatograph (LC) is introduced into an ESI probe 61, to which a positive high voltage supplied from a high-voltage power supply 35 of an ESI ion source 62 is applied, so that it is nebulized as positively charged fine liquid droplets into the atmosphere and is ionized. The positive multiply-charged ions produced are introduced through apertures formed in partitions 63 and 73 into a vacuum region of a mass spectrometer system evacuated to a high-vacuum by the (not-shown) turbo-molecular pump. Between the partitions 63 and 73, there is formed an intermediate pressure region which is evacuated by the (not-shown) oil rotary pump. An acceleration voltage is applied from a power supply 75 to the region between the partitions 63 and 73 so that the ions introduced from the ion source 62 are accelerated. In short, the partition 63 acts as an ion acceleration electrode. After this, the multiply-charged ions introduced into the vacuum region are focused by a lens 64 and then flow from between electrodes 30*b* and 30*c* into an electrostatic quadrupole deflector 30 so that they are deflected clockwise by 90 degrees. The deflection of the ions by the electrostatic quadrupole deflector 30 is disclosed in Unexamined Published Japanese Patent Application No. 2000-357488.

The electrostatic quadrupole deflector 30 is constructed of four sector (having a deflection angle of 90 degrees) columnar electrodes (30*a*, 30*b*, 30*c* and 30*d*). In order to deflect the positive ions clockwise by 90 degrees, as shown in FIG. 1, the positive DC voltage supplied from an electrostatic quadrupole deflector power supply 36 is applied to the electrodes 30*a* and 30*c*, and the negative DC voltage supplied from the electrostatic quadrupole deflector power supply 36 is applied to the electrodes 30*b* and 30*d*. The positive multiply-charged ions deflected clockwise by 90 degrees leave the electrostatic quadrupole deflector 30 from between the electrodes 30*a* and 30*b* and are delivered to an rf multipole ion guide 31, to which the high-frequency waves supplied from an rf power supply 32 is applied, so that they are introduced into an ion-trap volume 29 of the ion-trap mass spectrometer.

The ion-trap mass spectrometer is constructed of one doughnut-shaped ring electrode 13 and two endcap electrodes 11 and 15 arranged to sandwich the ring electrode 13. A main rf voltage is supplied and applied to the ring electrode 13 from a main rf power supply 17. As a result, an rf quadrupole field is formed in the ion-trap volume 29 which is formed of three electrodes. An supplementary AC voltage is suitably applied to the two endcap electrodes 11 and 15 from a supplementary AC voltage power supply 41 and is superposed over a quadrupole field in the ion-trap voltage 29 to establish a dipole field. The ions thus introduced into the ion-trap volume 29 are stably trapped in the ion-trap volume 29 by the actions of the rf quadrupole field. The ions trapped in the ion-trap volume 29 are then released in the mass order from the ion-trap field 29 by scanning the amplitude (or voltage) of the main rf voltage so that they are detected by a detector 16. The ion current detected is amplified by a DC amplifier and is delivered to a data processor 19. The data processor 19 collects a mass spectrum by controlling the ion-trap main rf supply 17, the supplementary AC voltage power supply 41, lens power supplies 65 and 71 and so on.

The negative ions for reducing the charge reduction by ion/ion reactions are produced in an APCI ion source 68.

A surfactant is known as a compound for producing positive/negative ions in an atmospheric pressure chemical ionization (APCI). In the present embodiment, a methanol solution 39 prepared to a concentration of 1 ppm from polyethylene glycol (PEG), polypropylene glycol (PPG), polyethylene glycol sulfate or the like is fed to the atmospheric pressure chemical ionization (APCI) ion source 68 by a pump 38.

The APCI ion source 68 is arranged to confront the ESI ion source 62 through the electrostatic quadrupole deflector 30. The methanol solution such as the PEG is nebulized from an APCI nebulizing probe 66 into the APCI ion source 68. After the nebulized flow was heated and gasified, the molecules of the PEG or the like are ionized with a corona discharge generated from the tip of a corona discharge needle 67, to which a high voltage is applied.

The PEG produces negative ions in the negative ionization mode of the APCI, as expressed by Formulas (7) to (9):

$$\text{PEG: } H\text{—}(\text{—}O\text{—}CH_2\text{—}CH_2\text{—})n\text{-}OH \rightarrow H\text{—}(\text{—}O\text{—}CH_2\text{—}CH_2\text{—})n\text{-}O^- \quad (7);$$

$$\text{PPG: } H\text{—}(\text{—}O\text{—}CH_2\text{—}CH_2\text{—}CH_2\text{—})n\text{-}OH \rightarrow H\text{—}(\text{—}O\text{—}CH_2\text{—}CH_2\text{—}CH_2\text{—})n\text{-}O^- \quad (8);$$

and $$\text{PEG Sulfate: } H\text{—}(\text{—}O\text{—}CH_2\text{—}CH_2\text{—})n\text{-}SO_4H \text{ AW } H\text{—}(\text{—}O\text{—}CH_2\text{—}CH_2\text{—})n\text{-}SO_4^- \quad (9).$$

As the surfactant, there are known an acidic compound (e.g., PEG-Sulfate), a basic compound (e.g., PEG-Amine) and a neutral compound (e.g., PEG). The acidic surfactant can be exploited for the negative reactant ions, and the basic surfactant can be exploited for the positive reactant ions. The neutral surfactant (e.g., PEG) is enabled to produce the positive/negative bipolar reactant ions by switching the ionization modes in the APCI ion source 68. Specifically, the polarity of ions to be produced is determined on the polarity of the voltage applied to the corona discharge needle 67. For example, positive ions are produced if a positive high voltage is applied to the corona discharge needle 67, and negative ions are produced if a negative high voltage is applied to the corona discharge needle 67. Positive/negative bipolar reactant ions can be provided from a single solution of neutral surfactant.

In the case of the surfactant such as the PEG, moreover, it is possible to acquire samples of different molecular weights easily according to a polymerization degree. Therefore, it is possible to prepare reactant ions of a molecular weight corresponding to the multiply-charged ions of the sample. The researcher can select the reactivity and the molecular weight freely to facilitate the analysis of the measurement result.

In dependence upon the reactivity of the multiply-charged ions produced, it is necessary to interchange the kinds of negative reactant ions. In order to acquire the structural information of the multiply-charged ions, moreover, the negative reactant ions may be changed. This is the case in which the negative reactant ions are to be changed from polyethylene glycol PEG to polypropylene glycol PPG or PEG-Sulfate or further to other negative ions. Then, the pump 38 may switch the suction from the methanol solution 39 to the PPG solution 40 or another solution.

The negative ions produced in the APCI ion source 68 are introduced through the intermediate pressure region evacuated by the (not-shown) oil rotary pump between partitions 72 and 69 into the vacuum region of the mass spectrometer system evacuated to a high vacuum by the (not-shown) turbo-molecular pump. Between the partitions 69 and 72, there is applied an acceleration voltage from a power supply 74 to accelerate the ions coming from the APCI ion source 68. In short, the partition 69 acts as an ion acceleration electrode. The ions introduced into the vacuum region are focused by a lens 70 and are then delivered to the electrostatic quadrupole deflector 30. In order to deflect the positive multiply-charged ions produced in the ESI ion source 62 clockwise by 90 degrees, the positive DC voltage has already been applied to the electrodes 30*a* and 30*c*, and the negative DC voltage has already been applied to the electrodes 30*b* and 30*d*. Under these conditions, the negative ions produced in the APCI ion source 68 are deflected counter-clockwise by 90 degrees and are ejected like the positive ions from between the electrodes 30*a* and 30*b* so that they are introduced through the rf multipole ion guide 31 into the ion-trap. In other words, without changing the voltages to be applied to the electrodes 30*a*, 30*b*, 30*c* and 30*d* of the electrostatic quadrupole deflector 30, the positive/negative ions produced in the two ion sources 62 and 68 can be simultaneously deflected by 90 degrees and introduced in one direction into the ion-trap mass spectrometer.

In case the sample to be measured is changed from protein to DNA, moreover, the DNA gives negative multiply-charged ions so that the measuring mode of the mass spectrometer system has to be switched from the positive ion mode to the negative ion mode. On the other hand, the reactant ions have to be changed to the ions of the polarity reversed from that of the DNA, i.e., to the positive ions. When the polarity of the APCI ion source is changed from negative to positive, stable and many positive ions can be given as in the case of the negative ions. In short, the PEG and the PPG can be said bipolar compounds. When the PEG or the PPG is used as the reactant ions, therefore, the solution itself for the reactant ions need not be changed as the polarities are changed between positive and negative. The PEG and the PPG produce positive reactant ions $BH^+$, as expressed in Formulas (10) and (11), in the positive ionization mode of the APCI.

$$\text{PEG: } H\text{—}(\text{—}O\text{—}CH_2\text{—}CH_2\text{—})n\text{-}OH \rightarrow H\text{—}(\text{—}O\text{—}CH_2\text{—}CH_2\text{—})n\text{-}OH_2^+ \quad (10);$$

and $$\text{PPG: } H\text{—}(\text{—}O\text{—}CH_2\text{—}CH_2\text{—}CH_2\text{—})n\text{-}OH \rightarrow H\text{—}(\text{—}O\text{—}CH_2\text{—}CH_2\text{—}CH_2\text{—})n\text{-}OH_2^+ \quad (11).$$

The produced positive reactant ion $BH^+$, i.e., $\text{—}H(\text{—}O\text{—}CH_2\text{—}CH_2\text{—})n\text{-}OH_2^+$ or $H\text{—}(\text{—}O\text{—}CH_2\text{—}CH_2\text{—}CH_2\text{—})n\text{-}OH_2^+$ reduces the charge of the negative multiply-charged ion by the ion/ion reaction with the negative multiply-charged ion $(m-nH)^{n-}$, as expressed by Formula (12).

$$(m-nH)^{n-}+BH^+ \rightarrow \{m-(n-1)H\}^{(n-1)}+B \quad (12).$$

The switching of the polarity of the ESI ion source 62 from positive to negative for ionizing the sample is made at first on the polarity of a high-voltage power supply 35. The polarity of the feed voltage to the lens 64 is also switched. The polarity of the electrostatic quadrupole deflector 30 has also to be switched so that the polarities of the voltage to be fed from the power supply 36 to the individual electrodes are switched. A negative DC voltage is applied to the electrodes 30*a* and 30*c*, and a positive DC voltage is applied to the electrodes 30*b* and 30*d*. The rf multipole ion guide 31 and the detector 16 are made to follow the polarity switching method being currently used. For switching the polarity of the APCI ion source 68 from negative to positive, there is switched the polarity of the high voltage to be fed and applied from a high-voltage power supply 37 to the corona discharge needle 67. In short, the switching is made from a negative high voltage to a positive high voltage. These switching operations can be performed by the polarity switching instructions from the data processor 19 to the individual power supplies. Both the multiply-charged ions produced in the ESI ion source 62 and the positive single-charged ions produced in the APCI ion source 68 are deflected in an ion-trapping direction (or rightward) by the electrostatic quadrupole deflector 30 and are introduced into the ion-trap mass spectrometer.

In case an ion-storage type mass spectrometer such as an ion-trap mass spectrometer or an FT-ICR (Fourier-transformation cyclotron resonance) mass spectrometer is used as the mass spectrometer, there are two methods for introducing the sample ions and the reactant ions.

The first method is to introduce positive/negative ions in a time sharing manner into the ion-trap mass spectrometer thereby to cause a charge reduction due to the ion/ion reactions in the mass spectrometer. The second method is to introduce positive and negative ions simultaneously into the electrostatic quadrupole deflector 30 thereby to cause a charge reduction due to the ion/ion reactions at a stage (in the rf multipole ion guide 31, for example) before introduced into the ion-trap mass spectrometer.

In either method, the quantities of currents of positive and negative dipole ions to be produced in the two ion sources 62 and 68 are not equal so that the degree of progress of the charge reduction of the ion/ion reactions has to be controlled. Specifically, the control is made on the ion ratio of the negative reactant ions from the ion source 68 to the positive multiply-charged ions produced in the ion source 62. The quantities of positive and negative ions to be introduced are controlled by turning ON/OFF the ion acceleration and by adjusting the voltages to be applied to the lenses 64 and 70.

As a control proper for the aforementioned first method, it is conceivable to change the time periods for introducing the positive and negative ions independently. In this case, prior to the ion/ion reactions, the positive reactant ions and the negative reactant ions are introduced independently of each other into the ion-trap mass spectrometer, and their individual mass spectra are analyzed to measure the positive and negative ion current values. After this, the positive ion current value and the negative reactant ion current value are compared, and the ON/OFF time periods of the voltages (i.e., the ion acceleration voltage) to be applied between the partitions 63 and 73 and the partitions 69 and 72, as corresponding to the individual ion sources 62 and 68, are adjusted to adjust the quantity of ions to be introduced into the ion-trap mass spectrometer. When the ion current value of the negative reactant ions is two times as large as the ion current value of the positive multiply-charged ions, for example, the introduction time period of the negative ions is one half of or less than the introduction time period of the positive multiply-charged ions.

Here, the ion acceleration voltage means a voltage value capable for accelerating the ions. For turning OFF the introduction of the ions, the ion acceleration voltage to be applied to the ion acceleration electrode may be turned OFF to the ground potential. When the ion acceleration voltage of the negative ions between the partitions 69 and 72 is −10 V, for example, the negative ions are not introduced into the electrostatic quadrupole deflector 30 if the acceleration voltage is at 0 V. For turning ON the introduction of ions, on the other hand, the negative reactant ions are introduced into the electrostatic quadrupole deflector 30 if the ion acceleration voltage of −10 V is applied between the partitions 69 and 72. For the positive multiply-charged ions, too, a similar control can be made between the partitions 63 and 73.

As the control suited for not only the first method but also the second method, moreover, it is conceivable to control the values of voltages to be applied to the lenses 64 and 70 thereby to control the quantity of ions to be introduced into the electrostatic quadrupole deflector 30. When the ratio of the ion current of the negative reactant ions to that of positive multiply-charged ions is two times, for example, the application voltage value of the lens 70 is so adjusted that the current value of the negative ions may be one half or less. As a result, the positive and negative introduction time periods are equal, but the positive and negative ion currents to be introduced into the ion-trap mass spectrometer are balanced. Here in this case, prior to the ion/ion reactions, the positive ions and the negative reactant ions have be introduced independently of each other into the ion-trap mass spectrometer to analyze the individual mass spectra thereby to measure the positive and negative ion current values.

The first method is one intrinsic to the ion-storage type mass spectrometer. On the contrary, the second method can also be applied to the case in which the mass spectrometer is other than the ion-storage type. The first method will be described in the present embodiment, but the second method will be described in other embodiments.

Figure 6:
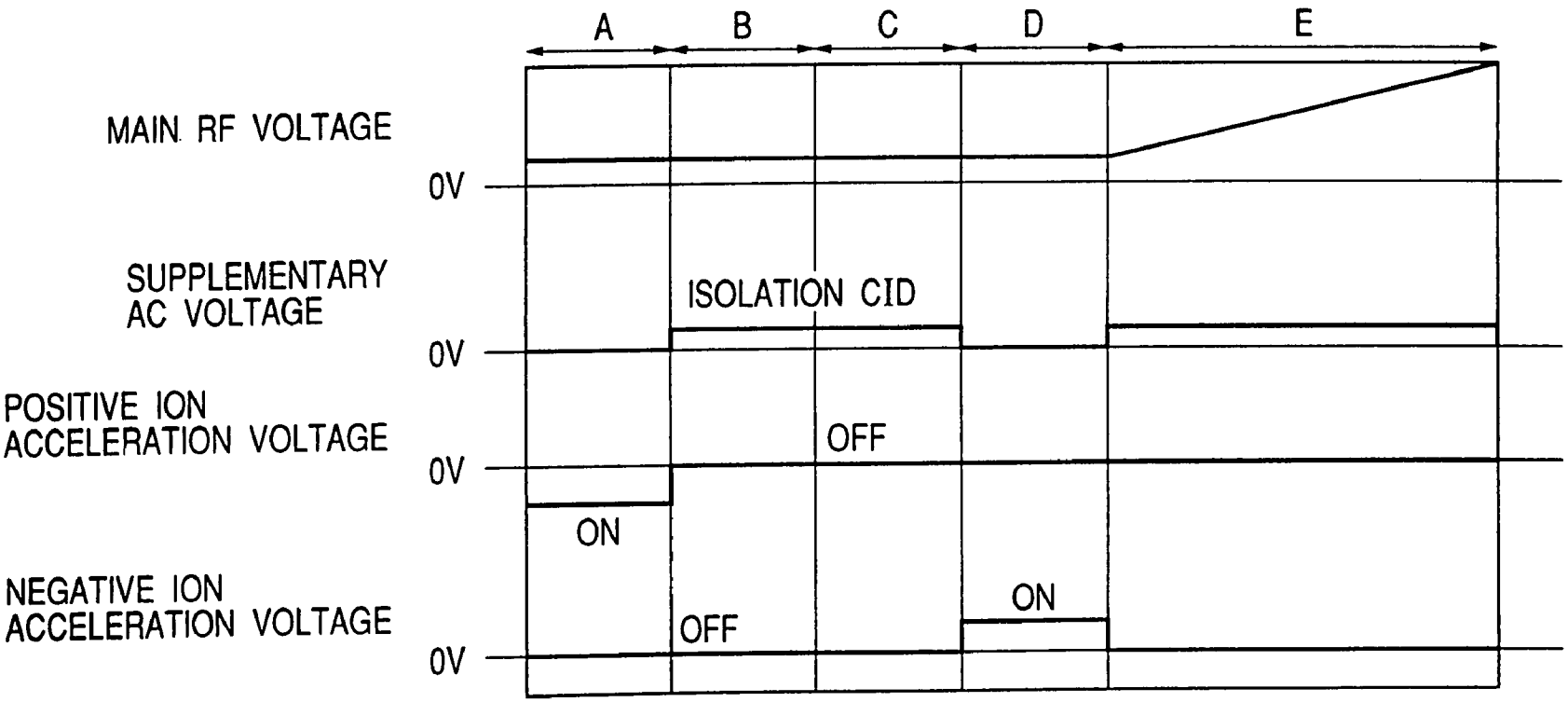
FIG. 6 is an action explaining diagram of Embodiment 1.

FIG. 6 illustrates an action sequence using the aforementioned first method.

The fundamental actions are the introduction of ions, the MS/MS, the introduction of reactant ions of the reversed polarity, the ion/ion reactions and the acquirement of mass spectra. These will be described in detail.

(1) A Period: Introduction Period of Sample Ions (Multiply-Charged Ions)

Figure 4:
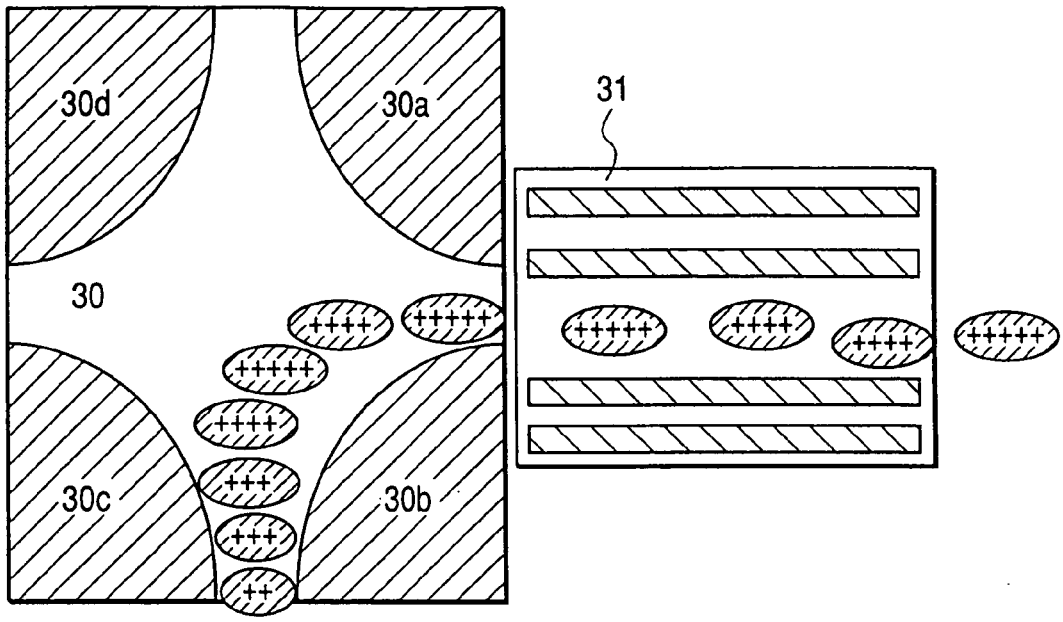
FIG. 4 is an action explaining diagram of sample ions.

First of all, the main rf voltage is applied from the power supply 17 to the ring electrode 13. Next, the ion acceleration voltage on the side of the ion source 62 is turned ON to introduce the positive ions into the electrostatic quadrupole deflector 30. The positive ions thus introduced into the electrostatic quadrupole deflector 30 are deflected clockwise by 90 degrees and are introduced through the rf multipole ion guide 31 into the ion-trap mass spectrometer (FIG. 4). On the other hand, the reactant ions of the reversed polarity are prevented from being introduced into the electrostatic quadrupole deflector 30 because the ion acceleration voltage on the side of the ion source 68 is OFF. In short, for a period A, only the positive multiply-charged ions of the sample are introduced into and stored in the ion-trap mass spectrometer.

(2) B Period: The B Period and the C Period are those for the MS/MS. Without MS/MS, the B and C Periods can be Skipped.

For the B period, precursor ions for the MS/MS are isolated from the multiply-charged ions of the sample, as stored for the A period. The supplementary AC voltage is applied between the endcap electrodes 11 and 15 to remove the ions other than the precursor ions from the ion-trap volume 29. There are known several other methods as the precursor ion isolating method. For this period, the ion acceleration voltage on the side of the ion source 62 is OFF to prevent the positive multiply-charged ions from being introduced into the electrostatic quadrupole deflector 30. On the other hand, the ion acceleration voltage on the side of the ion source 68 for the reactant ions remains OFF as for the A period.

(3) C Period: The Period for the Precursor Ions to be Excited and Dissociated (CID)

The supplementary AC voltage of the same frequency as the intrinsic frequency (or secular motion) of the precursor ions isolated for the B period is applied between the endcap electrodes 11 and 15 to form a dipole field in the ion-trap volume 29. As a result, a resonance excitation occurs between the dipole field and the precursor ions to cause the collisions between the precursor ions and the molecules of buffer gas frequently. As a result, the dissociations (i.e., Collision Induced Dissociation: CID) of the precursor ions can advance to produce many product ions.

Figure 5:
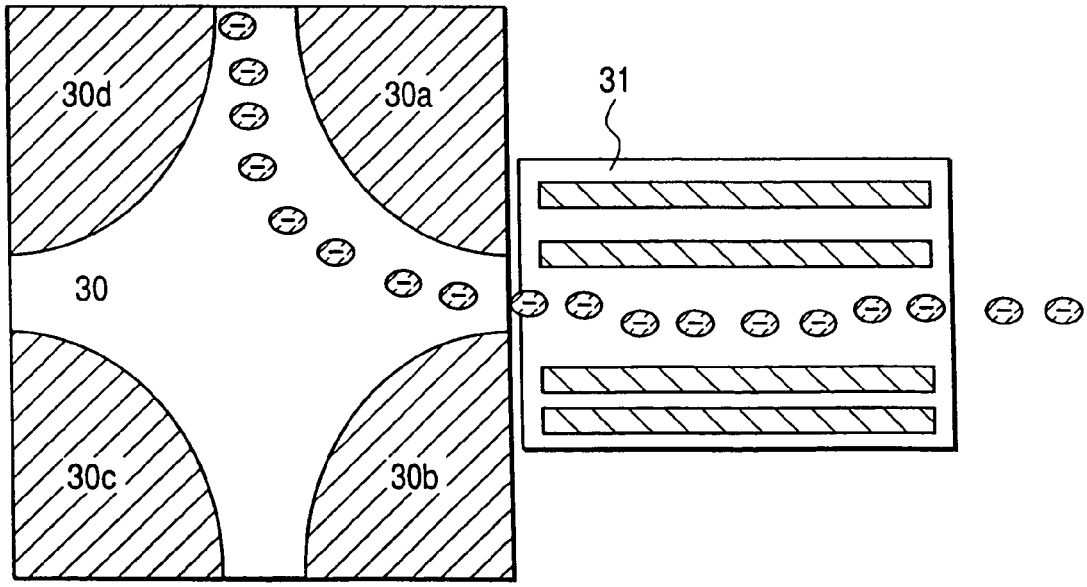
FIG. 5 is an action explaining diagram of reactant ions.

(4) D Period: The Charge Reduction Period of the Product Ions Due to the Ion/ion Reactions The supplementary AC voltage is turned OFF to end the CID. The ion acceleration voltage on the side of the ion source 62 is not applied as for the B and C periods but remains at the ground potential so that the positive multiply-charged ions are blocked. The ion acceleration voltage on the side of the ion source 68 is applied and turned ON to introduce the reactant ions into the ion-trap volume 29 (FIG. 5). The duration of this period D is set in advance by adjusting the aforementioned positive and negative ion quantities. For this period, the charge reduction due to the ion/ion reactions progresses in the ion-trap volume 29.

(5) E Period: The Period for Acquiring the Mass Spectra of Product Ions

In order to end the charge reduction reactions, the ion acceleration voltage on the side of the ion source 68 is turned OFF. The ion acceleration voltage on the side of the ion source 62 for the positive multiply-charged ions remains OFF. In order to acquire the mass spectra, the supplementary AC voltage is set to the voltage (of about 1 V) and frequency necessary for the resonance ejection of ions and is applied to the endcap electrodes 11 and 15. There is started the sweeping of the main rf voltage which is applied from the main rf power supply 17 and applied to the ring electrode 13. The product ions in the ion-trap volume 29 resonate in the mass order and are released to the outside of the ion-trap so that they can be detected by the detector 16 to acquire the mass spectrum by the data processor 19.

By repeating the actions (1) to (5), the data processor 19 acquires the mass spectra repeatedly.

Most of the negative ions introduced into the ion-trap volume 29 are consumed in the ion-trap volume 29 by the ion/ion reactions. However, the negative ions are partially left in the ion-trap volume 29 and are discharged from the ion-trap volume 29 to enter the detector 16, as swept with the main rf voltage, so that they give chemical noises to the low mass region. In order to prevent this, an electrode 57 is arranged between the endcap electrode 15 and the detector 16 so that the negative ions may be prevented from entering the detector by applying a negative voltage from a power supply 56 to the electrode 57. By applying the negative potential to the electrode 47, the negative ions are reflected upstream of the electrode 57 so that they fail to reach the detector 16. On the other hand, the positive ions are accelerated by the negative potential applied and reach the detector 16 so that the ion current is detected.

FIG. 13 to FIG. 16 present the results which were obtained in the present embodiment.

Figure 13:
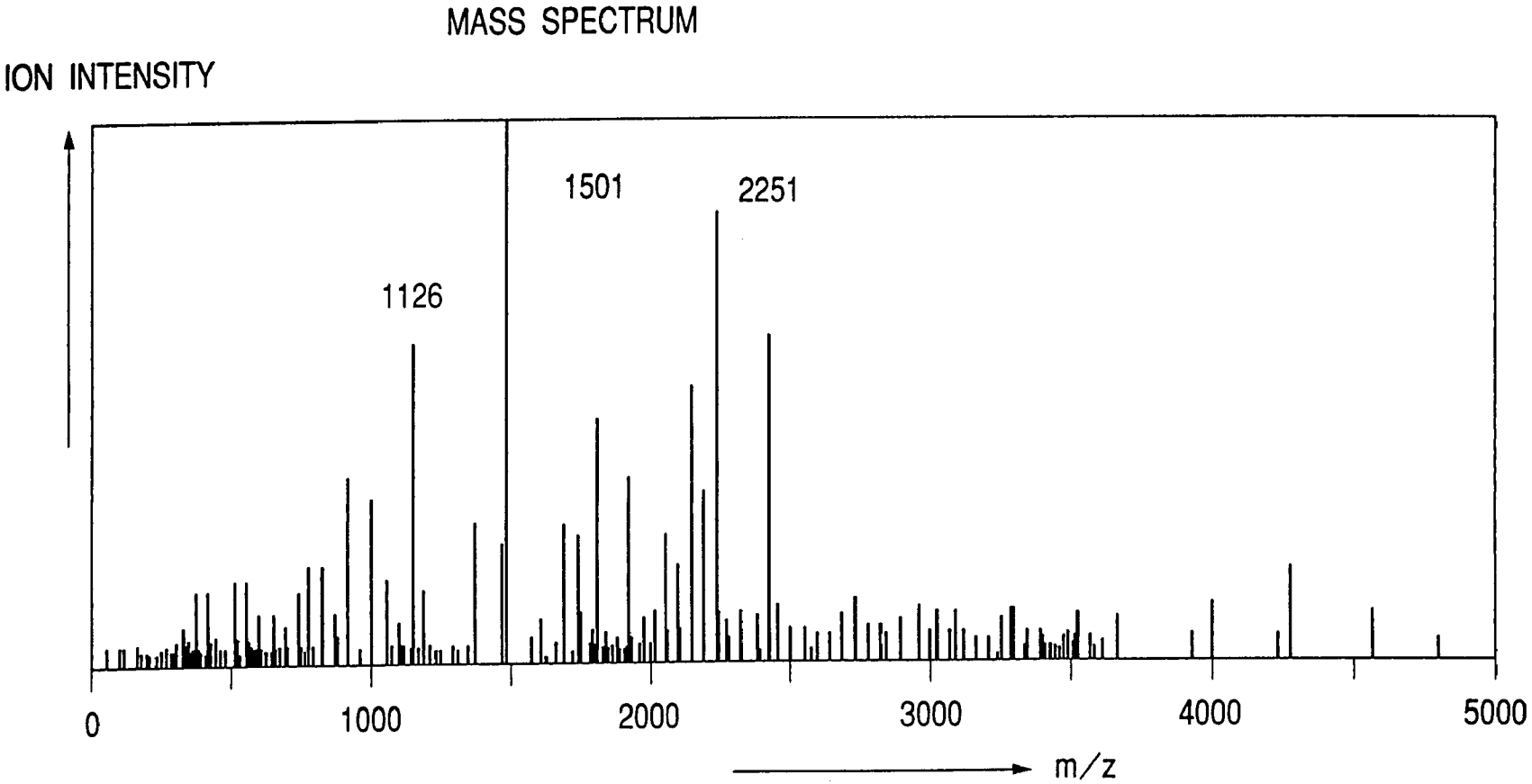
FIG. 13 is a mass spectrum obtained by the prior art method.
Figure 14:
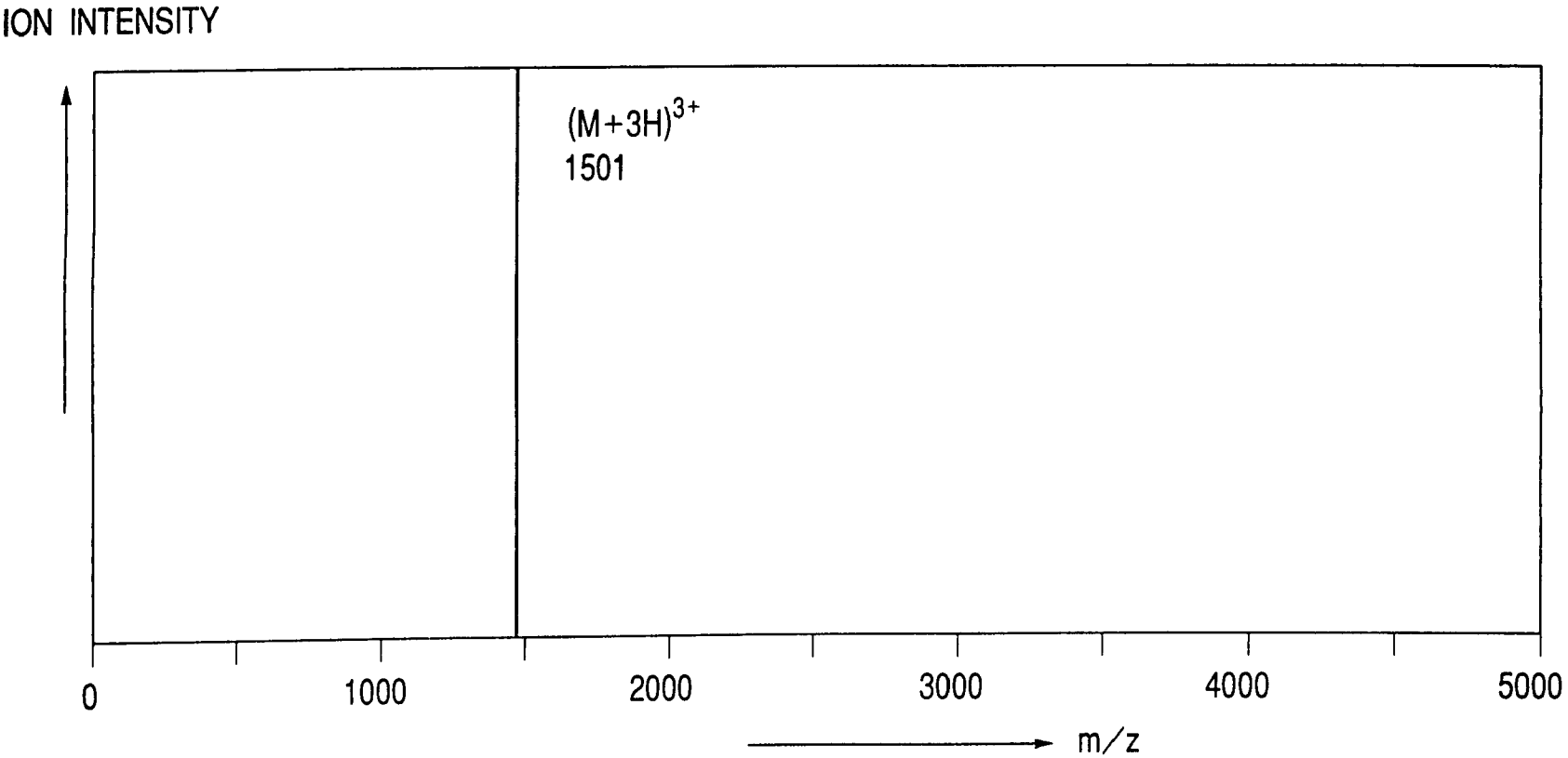
FIG. 14 is a mass spectrum of a component selected.

FIG. 13 presents the positive ion mass spectrum of a biological materials obtained in an LC/ESI-MS system, that is, the mass spectrum of the case in which neither the MS/MS nor the charge reduction reaction is done. The sample solution is separated in an LC column and is introduced into the ESI ion source 62. Because of an insufficient separation of the LC, many components are superposed and eluted. Therefore, the mass spectrum is so complicated that many chemical noises appear at m/z=3,000 or less over the mass peak of the sample components. The mass peaks of m/z=1,126, 1,501 and 2,251 are observed, but their assignments are unknown.

Next, the MS/MS was done to obtain the structural information of the eluted components. As presented in FIG. 14, the precursor ions of m/z=1,501 were isolated in the ion-trap volume 29 by the aforementioned method.

Figure 15:
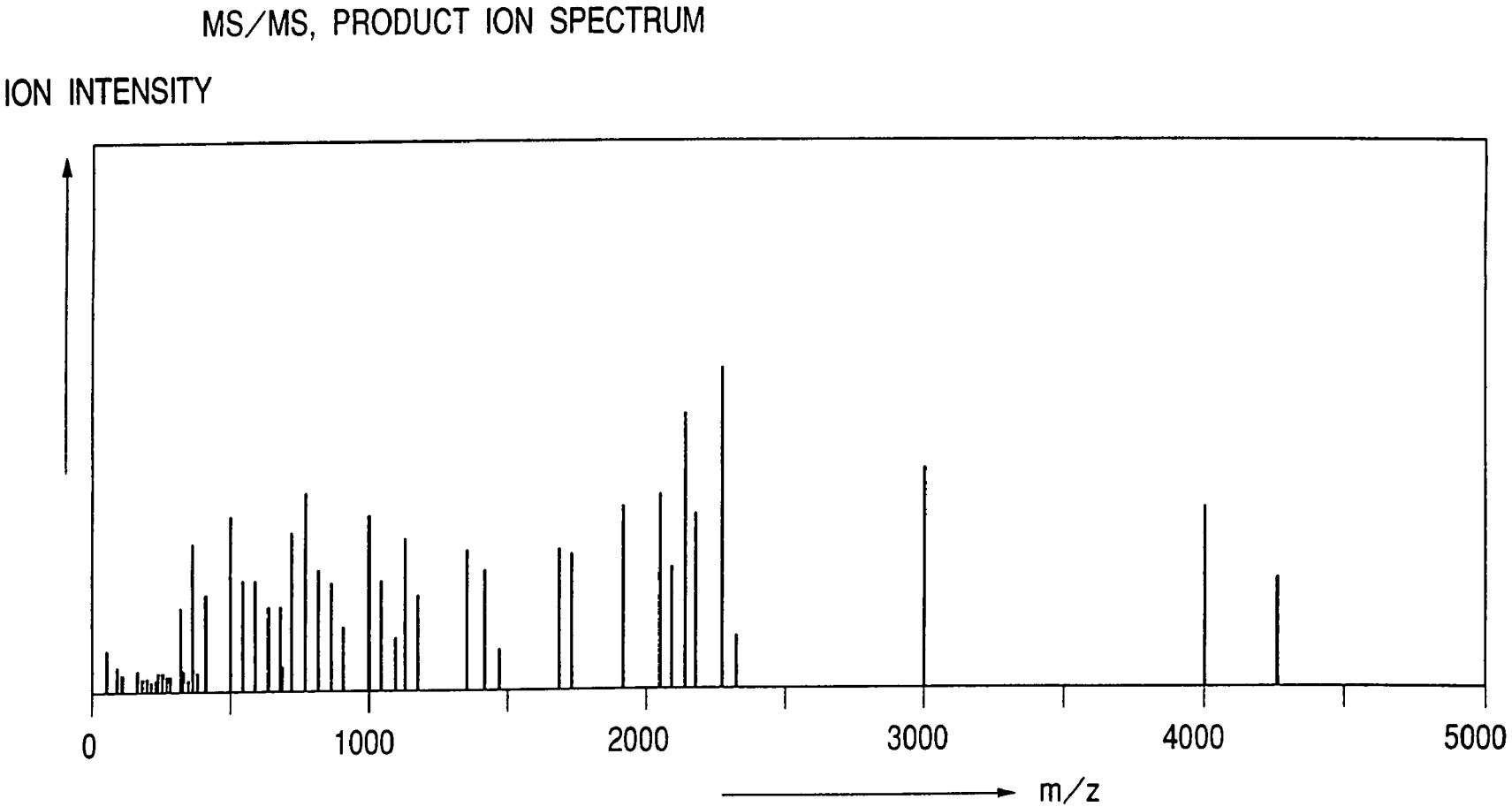
FIG. 15 is a mass spectrum of the product ions of the component of FIG. 14.

The mass spectrum of the product ions obtained by the precursor ions of m/z=1,501 were excited and dissociated (CID) is presented in FIG. 15. There appear mass peaks from m/z=4,000 to m/z=100. Any prominent mass peak does not appear to make it difficult to obtain the structural information directly from the mass spectrum. The mass spectrum of the product ions, as presented in FIG. 15, is complicated for the following reasons.

Now, let it be assumed that an N-kinds of product ions can be produced from one n-times charged precursor ion having charge number n. The N-kinds of product ions can have the charge numbers from one to n. Therefore, the product ions to be probably produced from the n-times charged precursor ions having charge number n can exist in n*N. If the precursor ions of m/z=1,501 shown in FIG. 14 have a charge number of 3 and produce ten kinds of product ions (or daughter ions), the probable product ion kinds of all are 3*10=30 kinds. As described hereinbefore, moreover, the multiply-charged product ions are complicated because they are higher than the m/z of the precursor ions due to their charge numbers (or positioned on the righthand side over m/z of the precursor ions or the mass spectrum) or lower than the m/z of the precursor ions (or positioned on the lefthand side on the mass spectrum). In FIG. 15, the ions over m/z=1,501 of the precursor ions can be supposed as the product ions of the multiply-charged ions, but their assignments are unknown. Therefore, even the relations between the adjoining ions over the mass spectrum cannot be supposed unless their charge number is known. This makes it difficult to analyze the mass spectrum of the multiply-charged product ions which are produced from the multiply-charged precursor ions.

Figure 16:
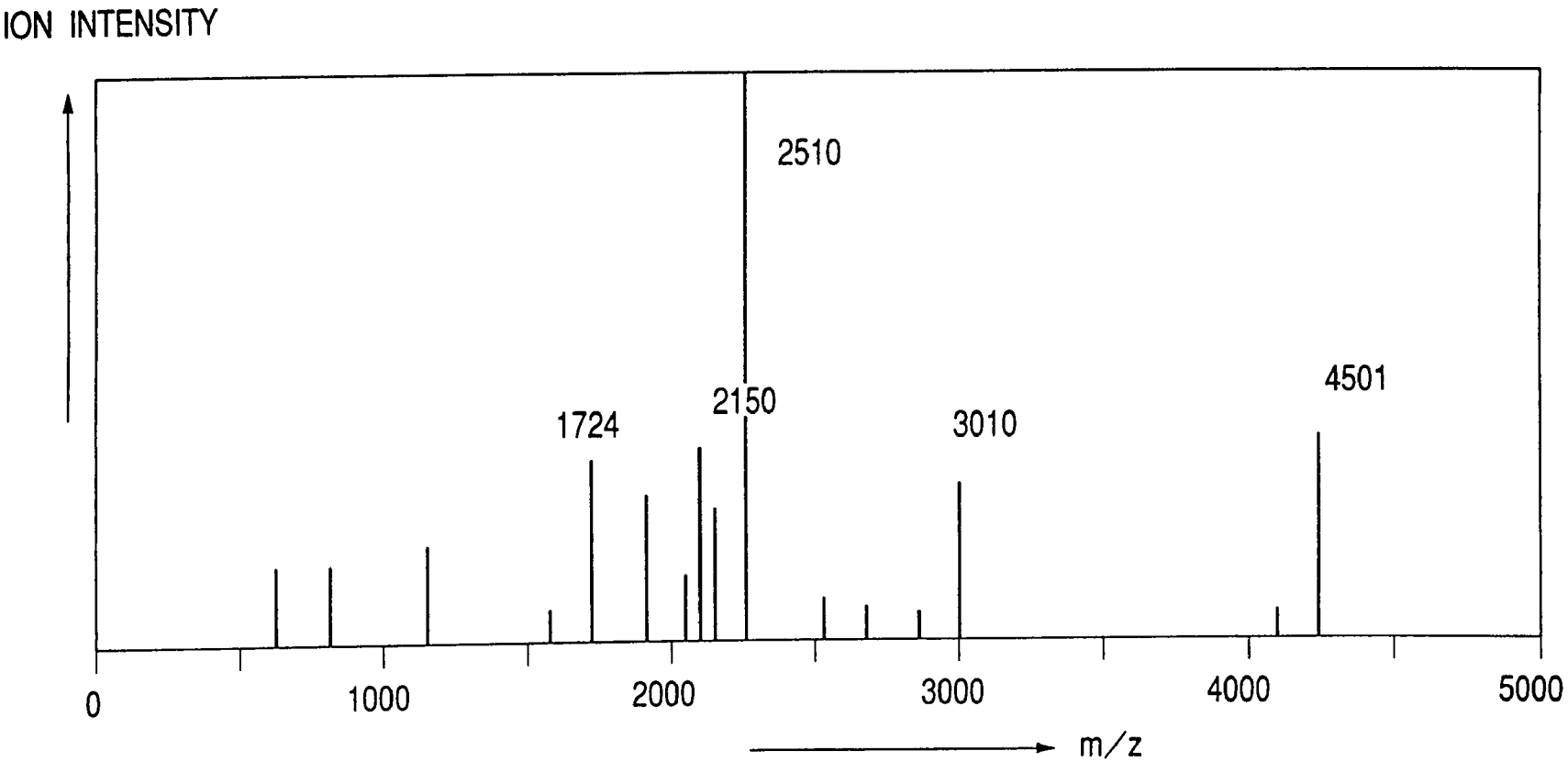
FIG. 16 is a mass spectrum obtained in the present invention.

In FIG. 16, there is presented the mass spectrum of product ions, after the PEG negative ions produced by the APCI were introduced after the MS/MS into the ion-trap volume so that the charge reduction is caused by the ion/ion reactions. As compared with FIG. 15, the ions of m/z=1,000 or less are reduced to simplify the mass spectrum. The charges of most ions is reduced to monovalence. Therefore, it is drastically simple to judge the assignments of ions. The information on the structure of peptide of the sample was obtained from the product ions having appeared especially in the region of m/z=2,510 to m/z=1,724.

In the aforementioned application, the MS/MS analysis selects the precursor ions, and the CID produces the product ions. However, a new application can be made not by producing the product ions by the CID but by performing the ion/ion reactions.

In order to omit the CID, the C period for exciting and dissociating the precursor ions may be skipped from the A to E periods for measuring using the ion-trap. For the B period, the precursor ions are isolated, and the next period is then skipped to the D period to reduce the charges of the precursor ions directly by the ion/ion reactions.

Figure 20:
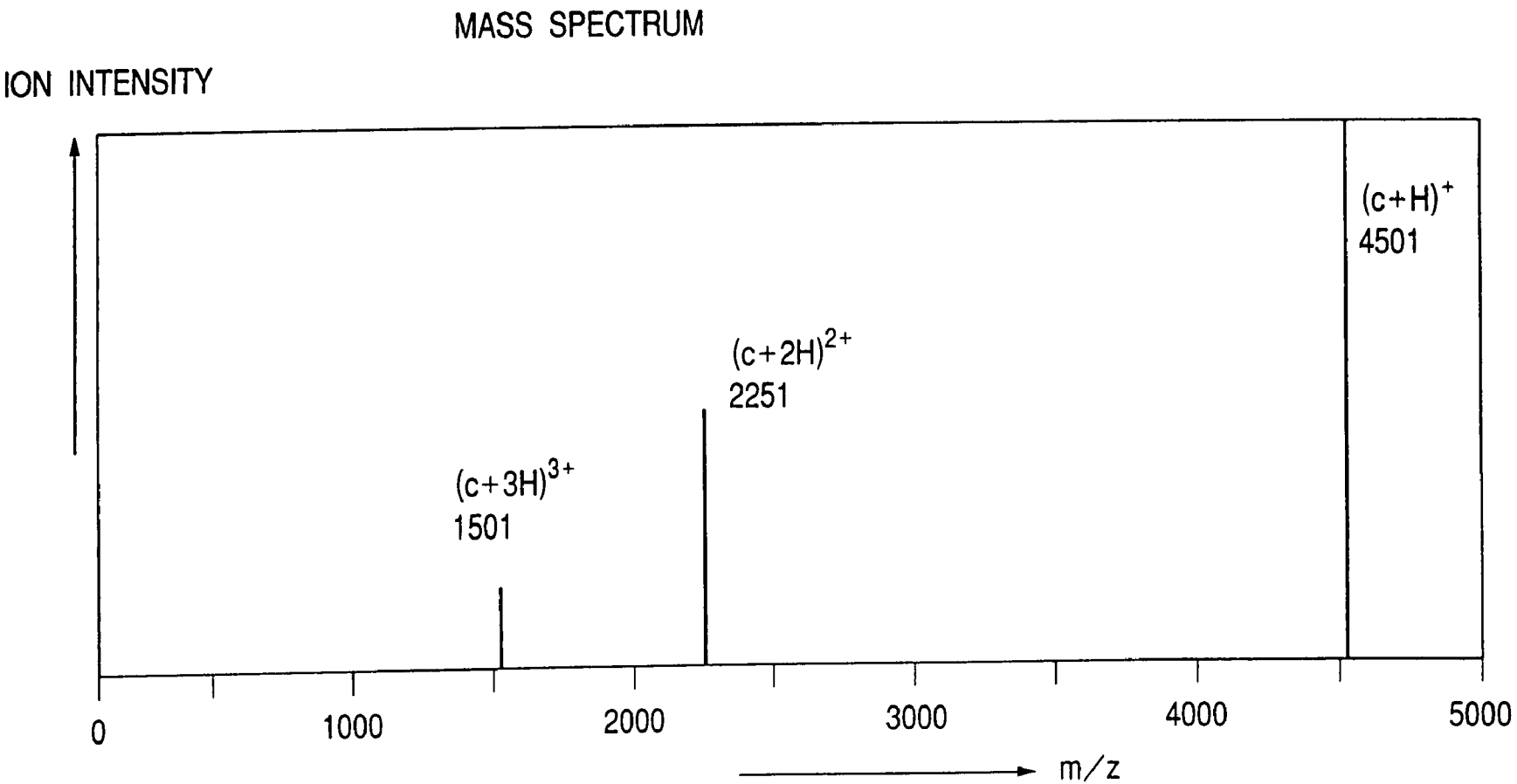
FIG. 20 is a mass spectrum for explaining the actions of the present invention.
Figure 21:
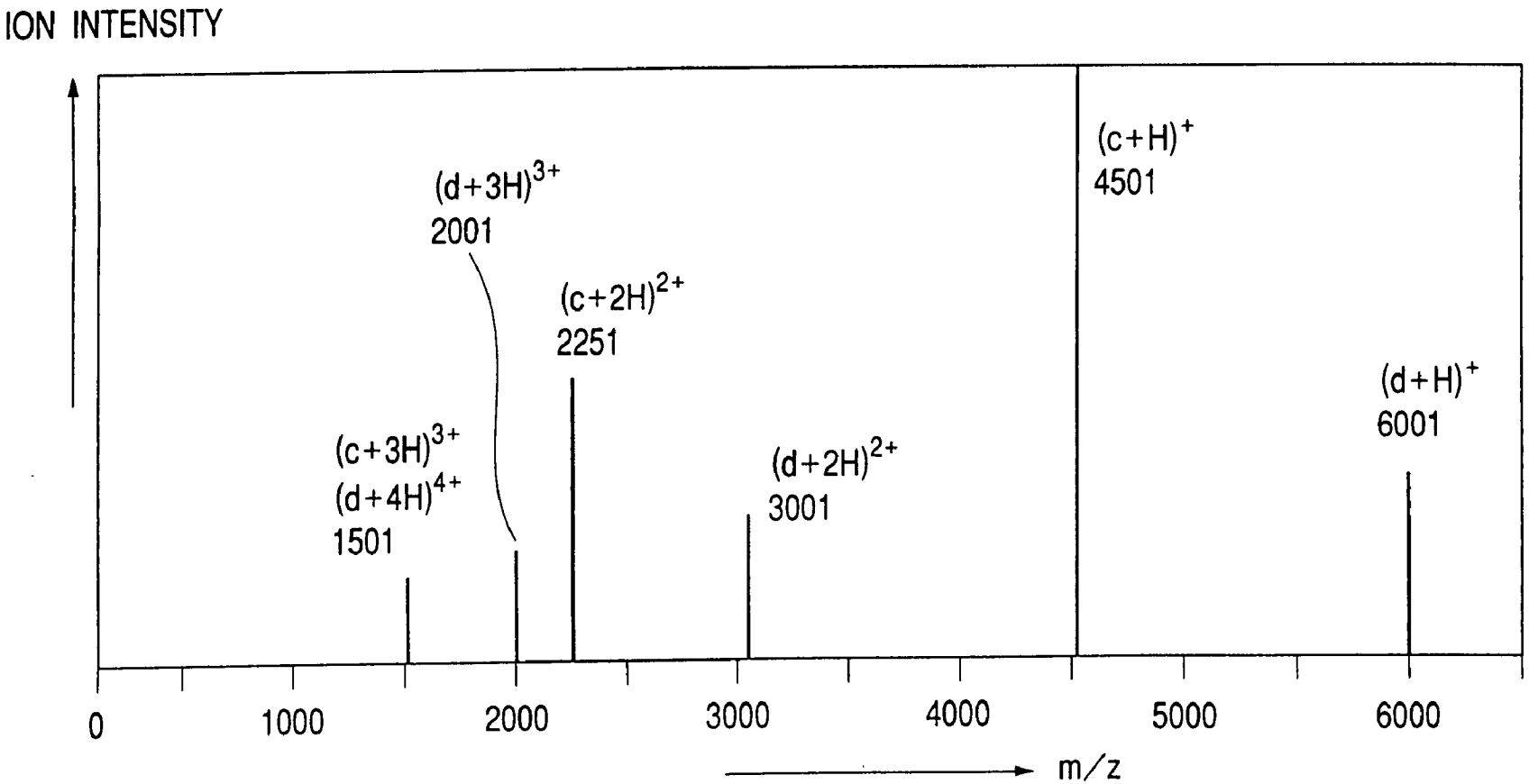
FIG. 21 is a mass spectrum for explaining the actions of the present invention.

FIG. 20 and FIG. 21 present the measurement results. In this example, for the same sample to be measured as that of FIG. 13, the ions of m/z=1,501 are selected as the precursor ions, as presented in FIG. 14. First of all, the ions are introduced (for the A period), and the precursor ions (m/z=1,501) are then isolated (for the B period). These precursor ions are caused to react with negative ions thereby to reduce the charges of the precursor ions (for the D period). As a result, there is obtained the mass spectrum of the precursor ions (for the E period), from which the charged are reduced, as shown in FIG. 20. Only three mass peaks appear on the mass spectrum without any other chemical noise being found. From this, it is determined that the ions of m/z=1,501 are triple-charged ions and have a molecular weight of 4,500.

In case a plurality of multiply-charged ions are superposed over the ions of m/z=1,501, too, the analysis can be simply made. By the charge reducing reactions of the precursor ions of m/z=1,501, there was obtained a mass spectrum, as presented in FIG. 21. From this mass spectrum, it has been found that at least two components were superposed as the multiply-charged ions over the mass peak of m/z=1,501. Two components having molecular weights of 6,000 and 4,500 exist, and these quadruple-charged and triple-charged ions are superposed to appear with the m/z=1,501. By integrating the intensities of ions derived from those components, moreover, the schematic mixing ratio can be supposed. In this case, it is found that a d component is about 55% with respect to a c component.

In the prior art, the purity of the multiply-charged ions could be detected only by the FT-ICR having a remarkably high resolution. According to the construction of the present embodiment, even the ion-trap mass spectrometer system is enabled to determine the purity of ions easily by the ion/ion reactions.

Embodiment 2

Figure 2:
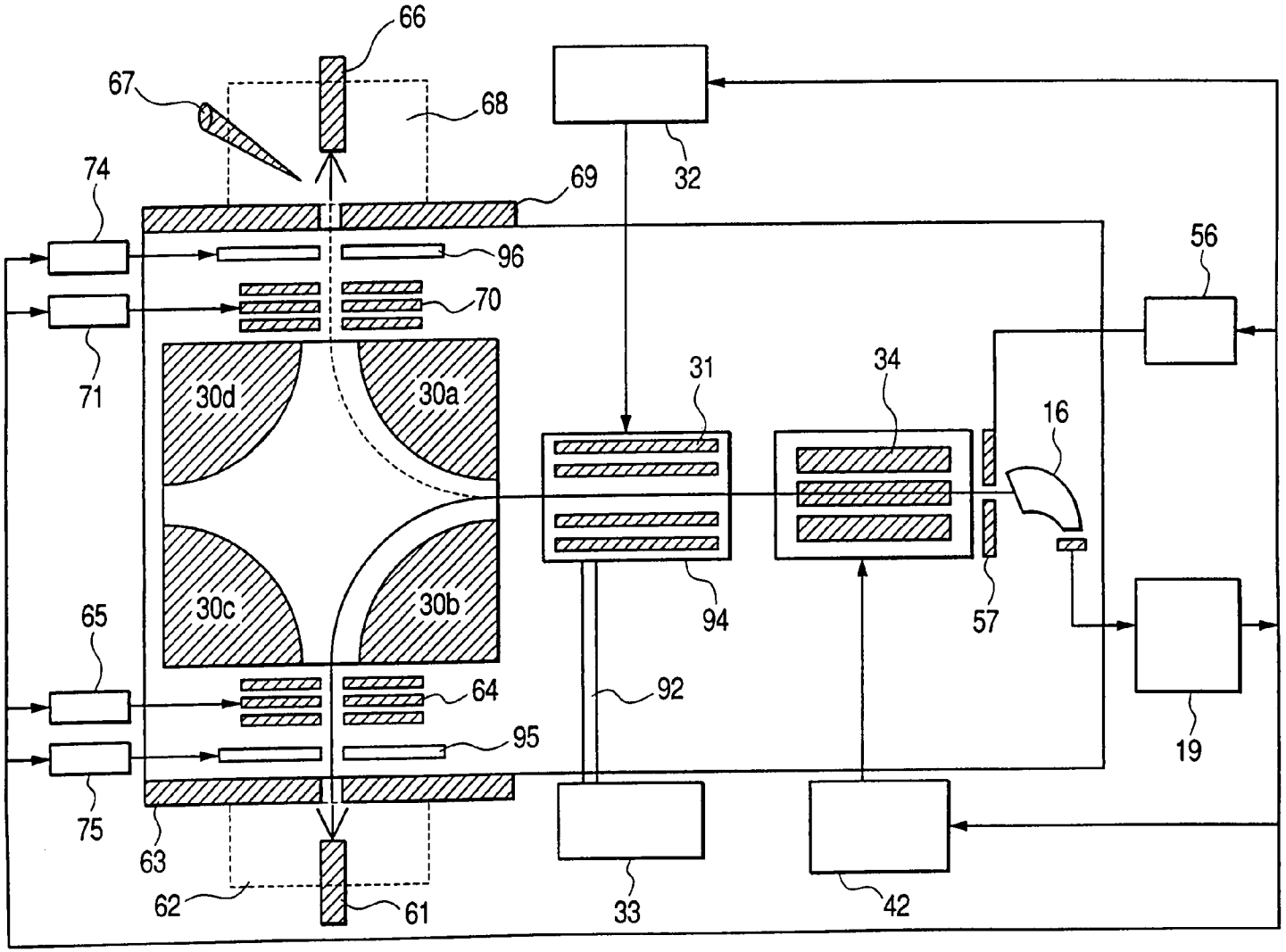
FIG. 2 is a schematic diagram of Embodiment 2.

FIG. 2 shows another embodiment of the present invention.

This embodiment presents an example using a quadrupole mass spectrometer (QMS) or a magnetic sector-type mass spectrometer as the mass spectrometer unlike Embodiment 1. The remaining structures are identical to those of Embodiment 1. Here in the drawings to be used for explaining the present subsequent embodiments, these embodiments will be disclosed by omitting the construction of the intermediate pressure region disclosed in FIG. 1. Moreover, the present embodiment is provided with acceleration electrodes 95 and 96 for accelerating the ions. These acceleration electrodes are provided for accelerating the ions in a high-vacuum region without accelerating the ions in the low-vacuum region such as the partitions 63 and 73 or the partitions 69 and 72 described in connection with Embodiment 1, but are identical to the partitions 63 and 73 and the partitions 69 and 72 in that they can turn ON/OFF the ions in accordance with the applied voltage value. These acceleration electrodes 95 and 96 are required in case the mass spectrometer is the magnetic sector-type mass spectrometer or a time-of-flight mass spectrometer (TOF-MS), as will be described hereinafter. This is because if the ions collide after accelerated against neutral molecules, their kinetic energy may be lost or expanded or they may be dissociated. Especially in the case of the ion-trap mass spectrometer or the quadrupole mass spectrometer (QMS) having no problem of the expansion of the kinetic energy, on the other hand, those acceleration electrodes can be dispensed with.

Figure 7:
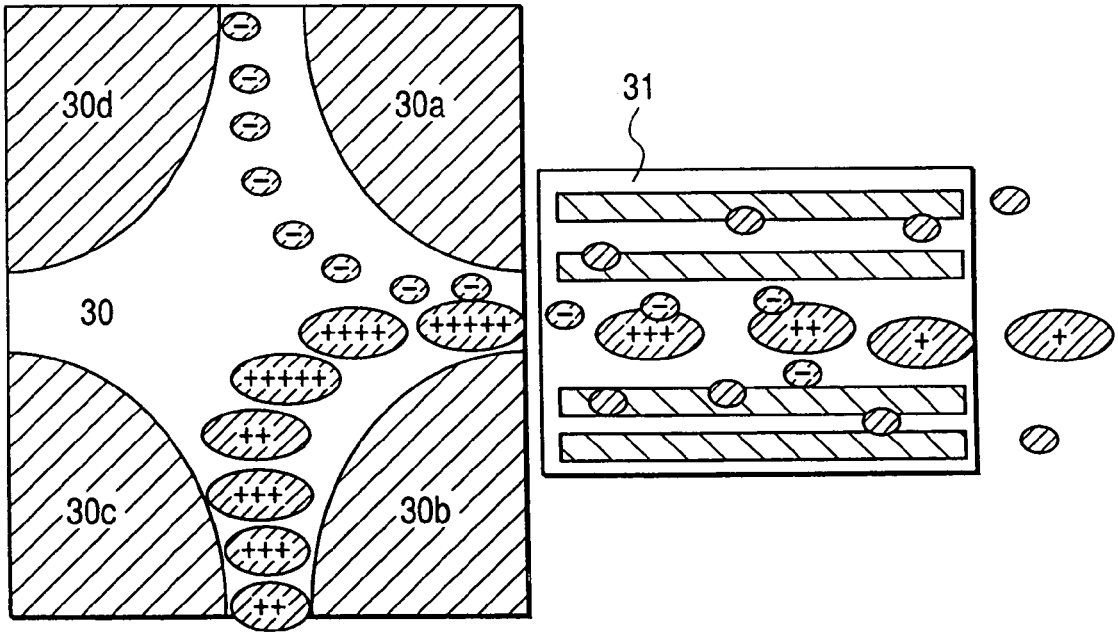
FIG. 7 is an action explaining diagram of Embodiment 2.

In the present embodiment, as shown in FIG. 7, the positive multiply-charged ions produced in the ESI ion source 62 and the negative reactant ions produced in the ion source 68 of the APCI are simultaneously introduced into the electrostatic quadrupole deflector 30 and are deflected. In short, the ions are introduced by using the second method which has been described in Embodiment 1.

As shown in FIG. 2, both the positive and negative ions ejected from between the electrodes 30*a* and 30*b* are then introduced into the rf multipole ion guide 31. In this rf multipole ion guide 31, a plurality of (four, six or eight) columnar electrodes are arranged on one circumference and are alternately connected with each other. The two sets of electrodes of the rf multipole ion guide 31 are supplied with a high frequency. Moreover, the electrodes of the rf multipole ion guide 31 are covered with a shielding metal cylinder 94. A He or $N_2$ gas in the gas reservoir 33 is fed as the buffer gas into the metal cylinder 94 via a pipe 92. The pressure in the rf multipole ion guide 31 is about 1 mTorr ($10^{-3}$ Torr). The positive and negative ions delivered into the rf multipole ion guide 31 are moved rightward (to the mass spectrometer) while being vibrated by the rf electric field. The positive and negative ions are caused to lose their kinetic energies by the collisions against the buffer gas and are delivered while being focused onto the center axis of the rf multipole ion guide 31. As illustrated in FIG. 7, the positive multiply-charged ions and the negative reactant ions attract each other by the Coulomb force as they are brought closer to each other by the focusing action of the rf electric field. When the positive ions and the negative ions collide, the protons are extracted from the positive multiply-charged ions by the negative ions so that the multiply-charged ions lose one charge. If the positive and negative ions are simultaneously introduced into the rf multipole ion guide 31, their charge reductions are progressed in the rf multipole ion guide 31 by the ion/ion reactions. The multiply-charged ions having reduced the charges are delivered for the mass spectrometry to a quadrupole mass spectrometer (QMS) 34. The multiply-charged ions having reduced their charges are detected for every masses by the detector 16 so that they give the mass spectrum in the data processor 19. The ions of the sample, which have reduced the charges and moved to a higher mass region, can be easily discriminated from the chemical noises.

Most of the negative ions introduced into the rf multipole ion guide 31 are consumed in the rf multipole ion guide 31 by the ion/ion reactions. However, the negative ions partially pass the quadrupole mass spectrometer 34 and enter the detector 16 so that they give the chemical noises to the low-mass region. The negative ions can be prevented from entering the detector 16 either by applying a negative bias potential to the quadrupole mass spectrometer 34 with respect to the rf multipole ion guide 31 or by arranging the electrode 57 between the mass spectrometer 34 and the detector 16 to apply the negative voltage to the electrode 57. By this application of the negative potential to the electrode 57, the negative ions are repulsed in front of the electrode 57 so that they fail to reach the detector 16. On the other hand, the positive ions are accelerated by the negative potential applied to the electrode 57 and reach the detector 16 so that the ion current is detected.

In Embodiment 2, the positive and negative ions have to be simultaneously introduced into the rf multipole ion guide 31. The positive and negative ions cannot be balanced in their quantities, even if their current values are different, by turning ON/OFF their introduction as in Embodiment 1. By controlling the voltages of the lenses 64 and 70, however, the difference in the quantities between the positive and negative ions can be balanced. In case the reactant ions are more than the ions of the sample, more specifically, the quantity of the reactant ions to enter the electrostatic quadrupole deflector 30 can be reduced by setting at a higher level the lens voltage to be applied to the lens 70.

Figure 17:
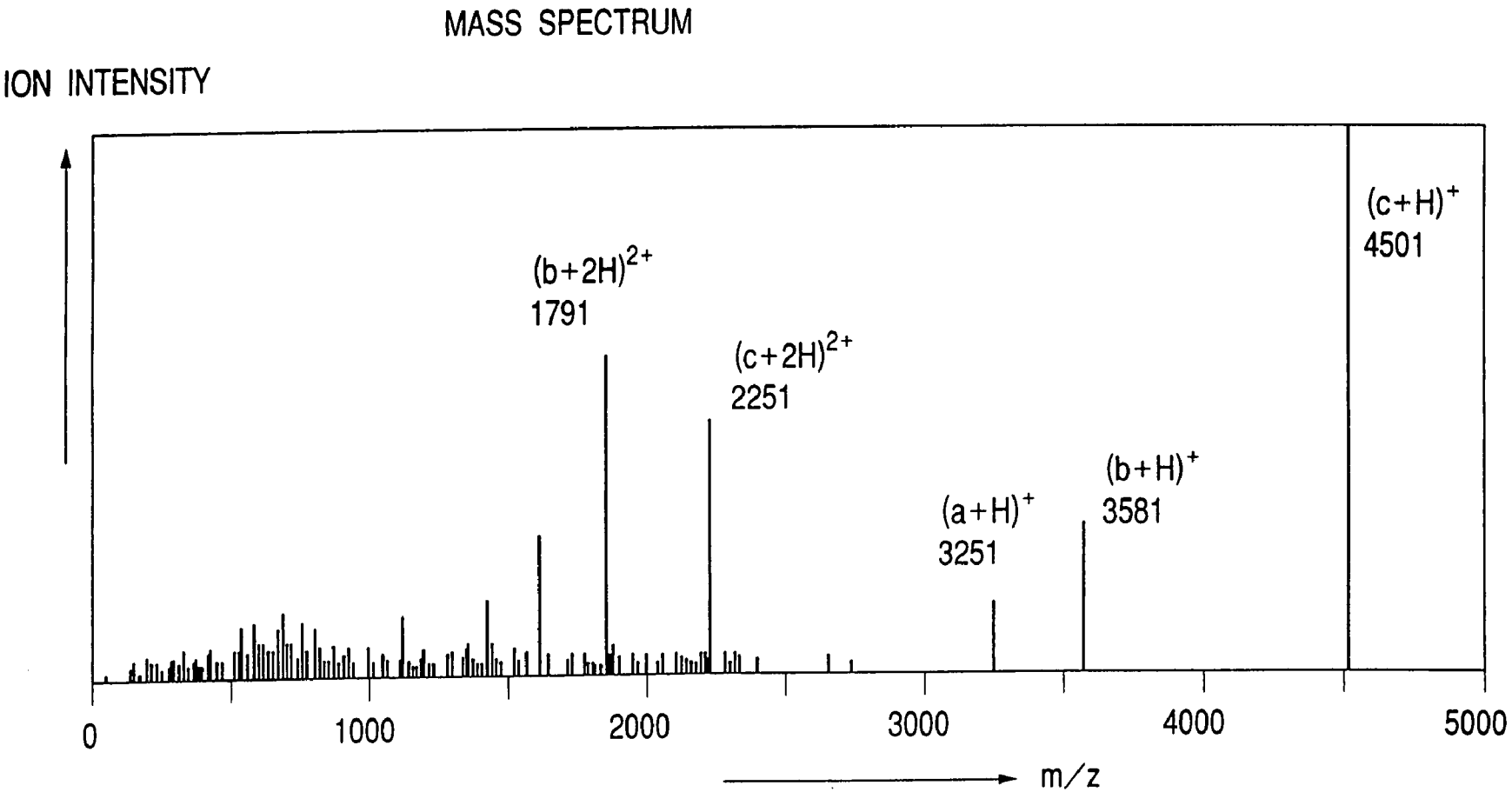
FIG. 17 is a mass spectrum obtained in the present invention.
Figure 18:
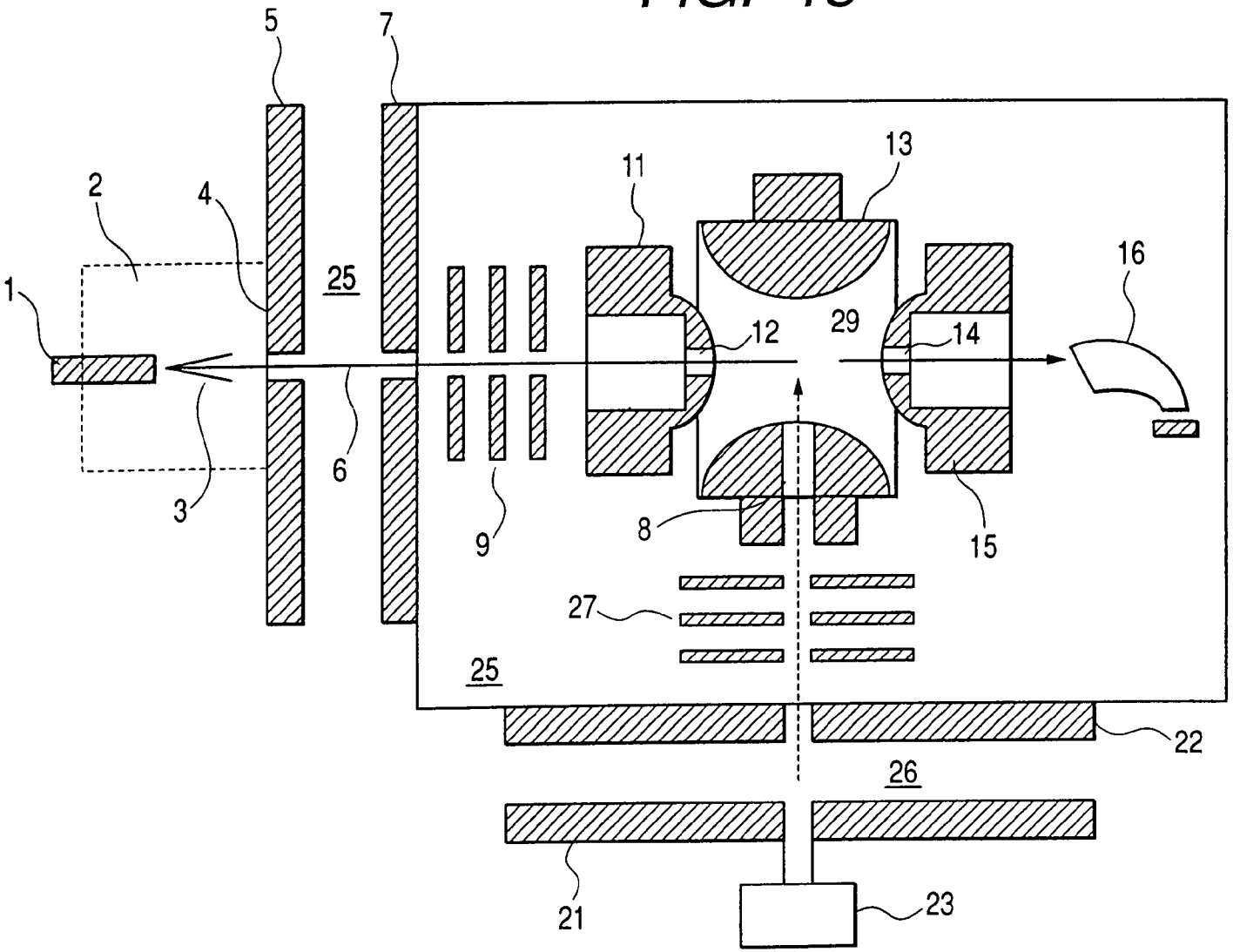
FIG. 18 is an explanatory diagram of the prior art.
Figure 19:
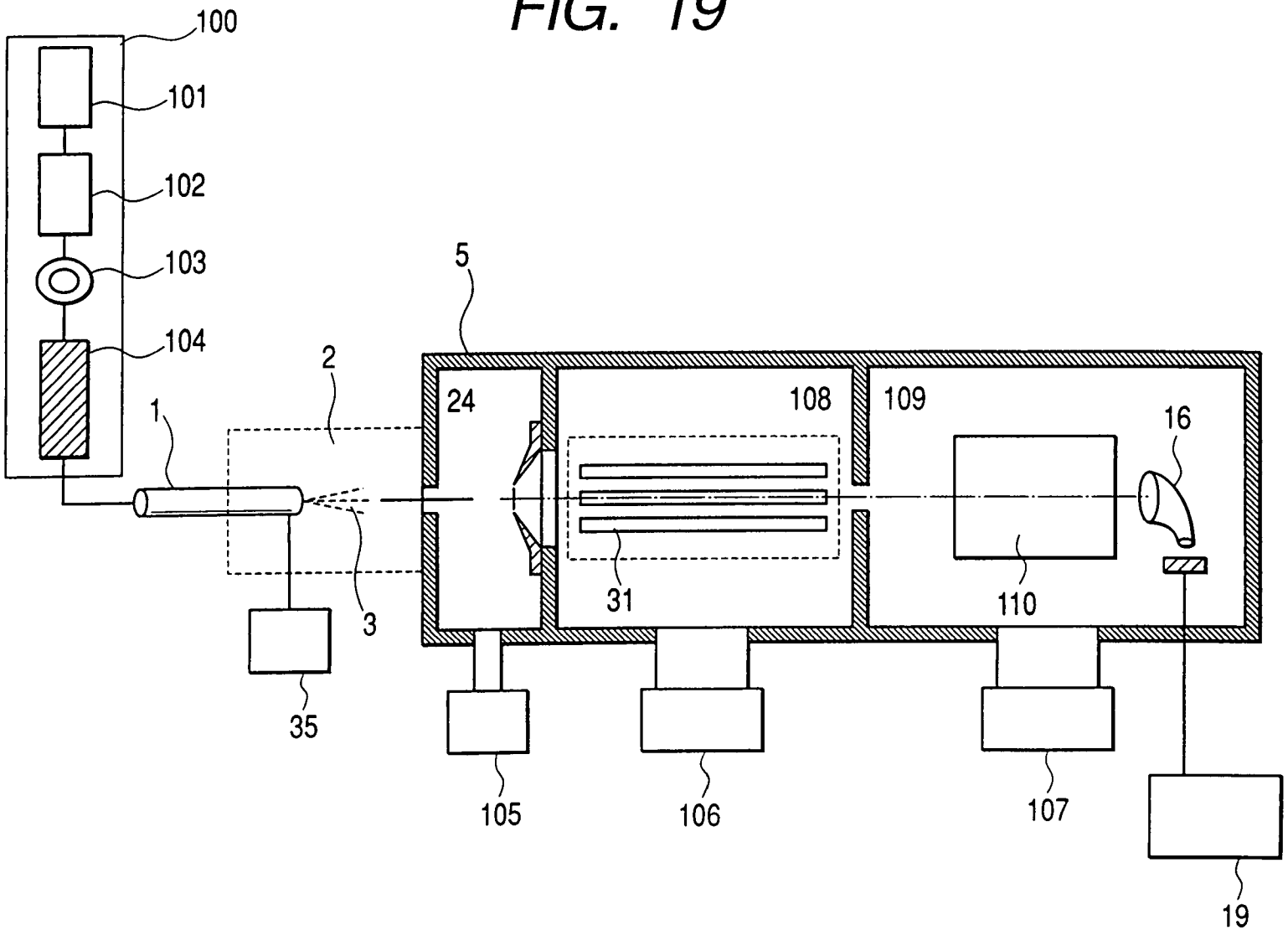
FIG. 19 is an explanatory diagram of the prior art.

FIG. 17 presents the result obtained in the present embodiment. The sample is identical to that used in Embodiment 1. In the case of a trace quantity of the sample, the ordinary LC/ESI-QMS gives a complicated mass spectrum, as presented in FIG. 13. In the ion/ion reactions according to the present embodiment, however, there is obtained the mass spectrum, as presented in FIG. 17. The chemical noises of m/z=3,000 or less reduce, and a mass peak of a high intensity moves to appear at m/z=2,000 or more. As a result, it is easy to discriminate the chemical noises and the signals. Moreover, the multiply-charged ions having the reduced charge number can be so simply analyzed that m/z=4,501 is interpreted as the single-charged ions of a component c, m/z=2,251 as the double-charged ions of the component c, m/z=3,581 as the single-charged ions of a component b, and m/z=1,791 as the double-charged ions of the component b. What is further noted is located at the peak of m/z=3,251. This peak is supposed to correspond to single-charged ions of a component a. This component a has not been observed even of its peak in the least in FIG. 13. From the measurements of the present embodiment, it has been found that there are at least three components eluted from the LC and introduced into the ESI ion source. Here has been described an applied example in which the mass spectrum was simplified not by the MS/MS but by the charge reduction of the multiply-charged ions by the quadrupole mass spectrometer.

Here, the present embodiment has been described on the case in which the mass spectrometer is the quadrupole mass spectrometer (QMS). In case the magnetic sector type mass spectrometer is used, the analysis using the ion/ion reactions like that of the present embodiment can be made by replacing the aforementioned construction of the quadrupole mass spectrometer 34 by that of the magnetic sector-type mass spectrometer.

Embodiment 3

Figure 3:
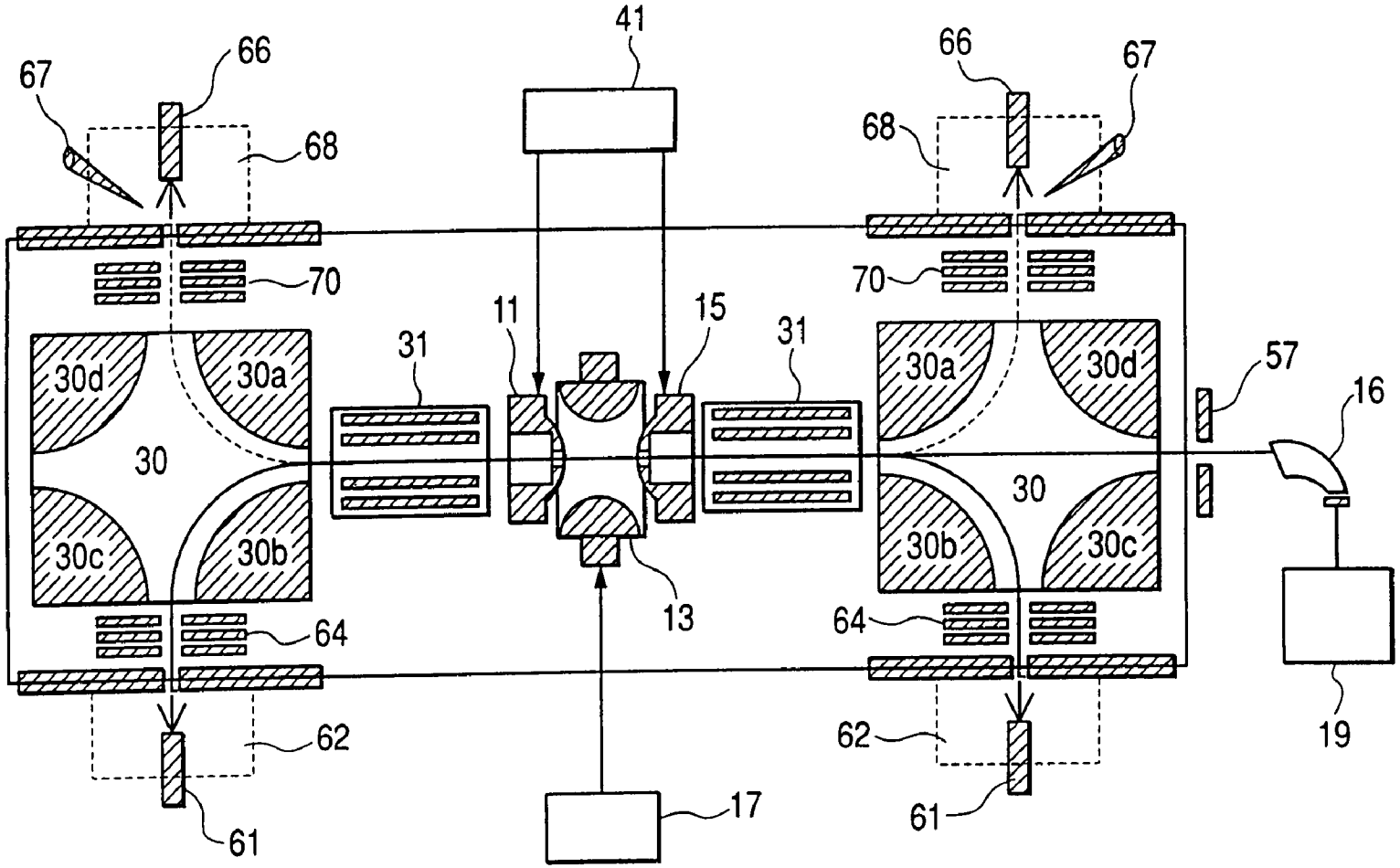
FIG. 3 is a schematic diagram of Embodiment 3.

FIG. 3 shows another embodiment. Here is described an ion-trap mass spectrometer which is provided with two sets of two ion sources and one electrostatic quadrupole deflector.

On the lefthand side of the ion-trap mass spectrometer, there is arranged the electrostatic quadrupole deflector 30 which is provided with the ESI ion source 62 for ionizing the sample and the APCI ion source 68 for the reactant ions, as has been disclosed in Embodiment 1. On the righthand side of the ion-trap mass spectrometer, moreover, there are symmetrically arranged an ESI ion source 62 for ionizing the sample, an APCI ion source 68 for the reactant ions, and an electrostatic quadrupole deflector 30'. The detector 16 is arranged on an axial straight line joining the electrostatic quadrupole deflectors 30 and 30'.

In the present embodiment, it is assumed that the sample ions of either set are once introduced into the ion-trap mass spectrometer, and that the charge reduction is performed by the ion/ion reactions as in Embodiment 1. However, the DC voltage to be applied to the electrodes of the electrostatic quadrupole deflector 30' is reversed in polarity from the voltage to be applied to the electrodes of the electrostatic quadrupole deflector 30. Specifically, the DC voltage to be applied to the electrodes 30*a*, 30*c*, 30*b*' and 30*d*' is positive, and the voltage to be applied to the electrodes 30*b*, 30*d*, 30*a*' and 30*c*' is negative.

A plurality of samples can be analyzed, if different, while the chromatograph being coupled to the two ion sources 62 and 62'. Specifically, the analyses can be so alternately made that the sample ionized by the lefthand ion source 62 is introduced into and analyzed by the ion-trap mass spectrometer and is detected by the detector 16, and that the sample ionized by the righthand ion source 62' is then introduced into and analyzed by the ion-trap mass spectrometer and is detected by the detector 16. Here, the ion/ion reactions can utilize the reactant ions from either of the APCI ion sources 68 and 68'. When the ion/ion reactions are done on the ions from the lefthand ion source 62, more specifically, the reactant ions from the APCI ion source 68 may be introduced into the ion-trap mass spectrometer. Alternatively, the reactant ions from the APCI ion source 68' may be introduced into the ion-trap mass spectrometer. The ions from the righthand ion source 62' can also utilize either of the APCI ion sources 68 and 68'.

The mass spectrum of the ions ejected from the ion-trap mass spectrometer is acquired by applying a high voltage to the lenses 64, 70, 64' and 70', by brocking the positive and negative ions and then by setting the four electrodes of the electrostatic quadrupole deflector 30' to the ground potential. The ions ejected from the ion-trap mass spectrometer are detected through the electrostatic quadrupole deflector 30 by the detector 16.

In Embodiment 3, too, the electrode 57, to which the negative potential is applied, is required for preventing the negative ions from entering the detector.

Embodiment 4

Figure 8:
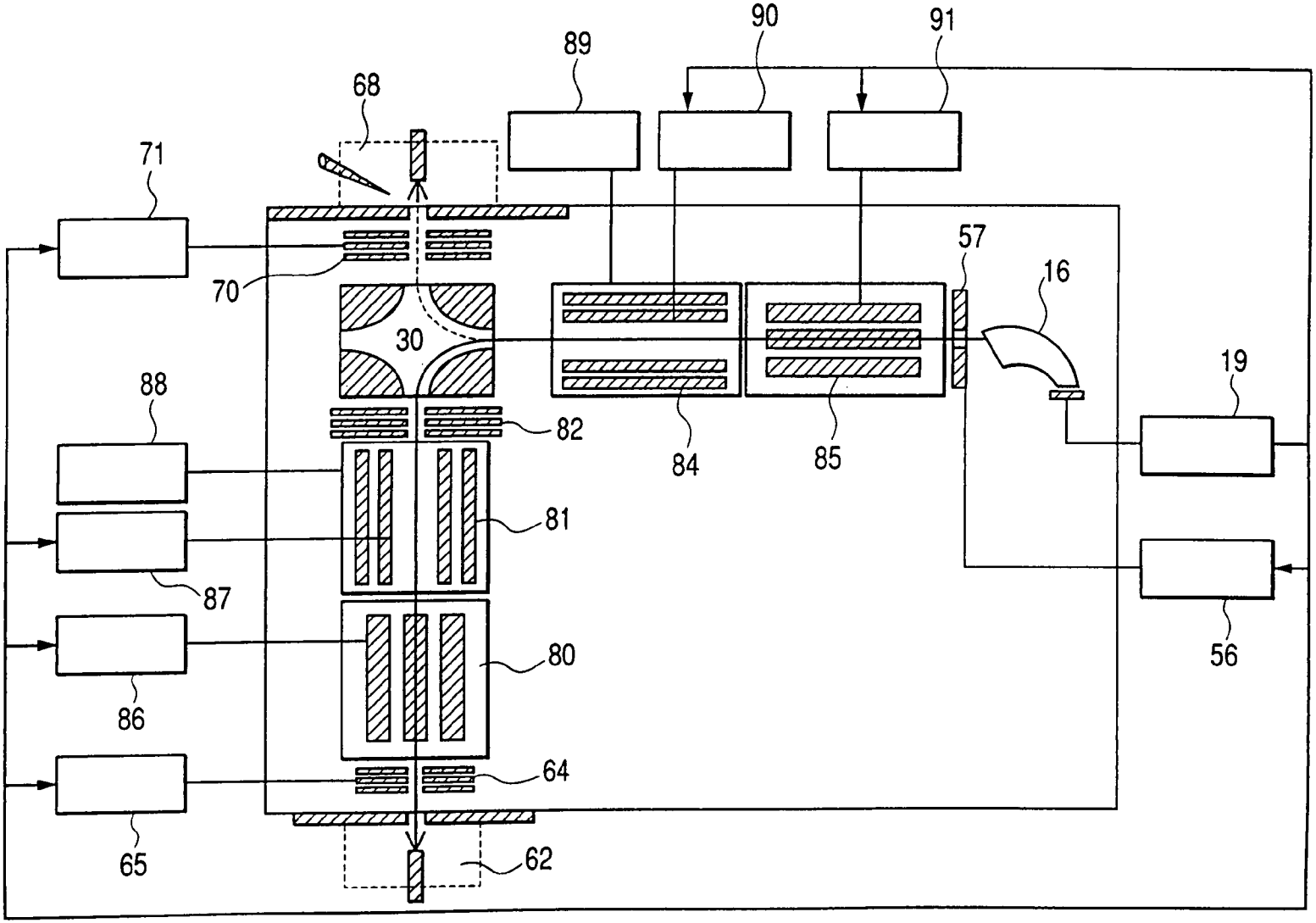
FIG. 8 is a schematic construction diagram of Embodiment 4.

FIG. 8 shows another embodiment. Here is shown an example of the construction for the MS/MS and the ion/ion reactions of the case in which the quadrupole mass spectrometer (QMS) is used as the mass spectrometer.

The multiply-charged ions produced in the ESI ion source 62 are introduced into the high-vacuum region. The sample solution introduced into the ESI ion source 62 is ionized to produce positive multiply-charged ions. The positive multiply-charged ions are focused by the lens 64 and introduced into a first QMS 80. The precursor ions are selected from the multiply-charged ions in the first QMS 80. The precursor ions are introduced from the first QMS 80 into an rf multipole ion guide 81. The precursor ions repeat, while passing through the rf multipole ion guide 81, the collisions against Ar gas molecules filling up the rf multipole ion guide so that they are excited and dissociated to produce many product ions. The product ions thus produced emanate from the rf multipole ion guide 81 and are focused by a lens 82. After this, the product ions are introduced into the electrostatic quadrupole deflector 30 so that they are deflected clockwise by 90 degrees. The negative reactant ions are produced in the APCI ion source 68 and are focused by the lens 70 so that they are introduced together with the positive product ions into the electrostatic quadrupole deflector 30. The negative reactant ions are deflected counter-clockwise by 90 degrees. The positive product ions and the negative reactant ions emanate from the electrostatic quadrupole deflector 30 and are simultaneously introduced in the same direction into an multipole ion guide 84. The positive and negative ions cause the charge reducing reactions while moving in the rf multipole ion guide 84, so that the product ions reduce the charges. The product ions having reduced the charges are introduced through the rf multipole ion guide 84 into a second quadrupole mass spectrometer (QMS) 85. By this second QMS 85, the product ions having reduced the charges are detected according to mass with the detector 16 so that the mass spectrum of the product ions are given by the data processor 19.

In the present embodiment, too, the electrode 57, to which the negative potential is applied, is required for preventing the negative ions from entering the detector.

Figure 9:
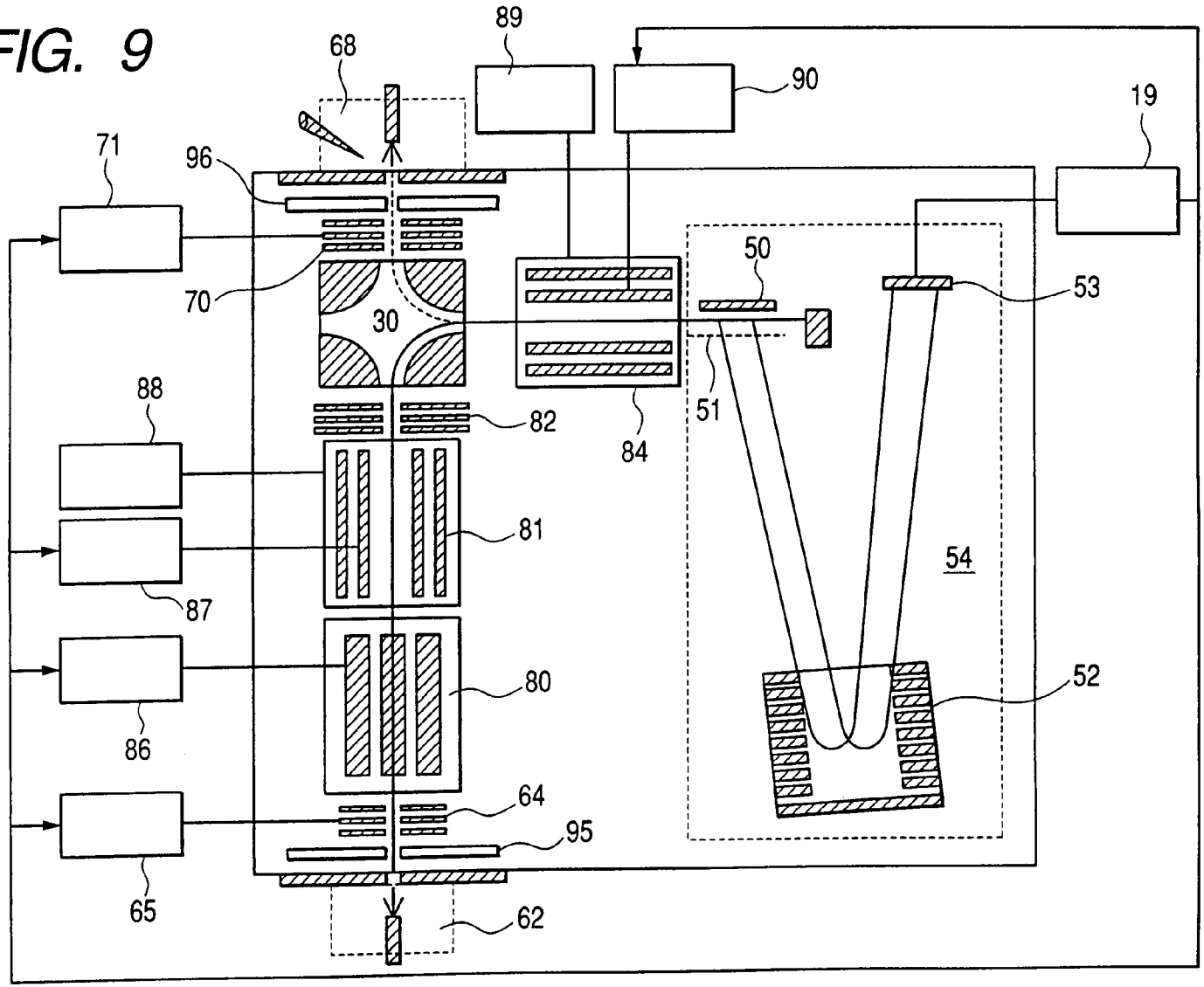
FIG. 9 is a schematic construction diagram of Embodiment 4.

FIG. 9 shows a modification of the embodiment of FIG. 8. The construction of FIG. 8 uses the quadrupole mass spectrometer (QMS) as the mass spectrometer, but the construction of FIG. 9 uses a time-of-flight mass spectrometer (TOF-MS) as the mass spectrometer.

The positive multiply-charged ions produced in the ESI ion source 62 are introduced into the high-vacuum region of the mass spectrometer system. The ions focused by the lens 64 are introduced into the QMS 80. Here, the precursor ions are selected from the multiply-charged ions. The precursor ions are introduced from the QMS 80 into the rf multipole ion guide 81. The precursor ions repeat, while passing through the rf multipole ion guide 81, the collisions against the Ar gas molecules filling up the rf multipole ion guide so that they are excited and dissociated (CID) to give many product ions. The product ions produced emanate from the rf multipole ion guide 81 so that they are focused by the lens 82 and introduced into the electrostatic quadrupole deflector 30. The positive product ions are deflected clockwise by 90 degrees. The negative reactant ions are produced in the APCI ion source 68 and are focused by the lens 70 so that they are introduced together with the positive product ions into the electrostatic quadrupole deflector 30. The negative reactant ions are deflected counter-clockwise by 90 degrees. The positive product ions and the negative reactant ions emanate from the electrostatic quadrupole deflector 30 and are introduced simultaneously in the same direction into the rf multipole ion guide 84. Here, the positive and negative ions causes the charge reduction reactions so that the charges of the product ions reduce. The product ions having reduced the charges are introduced through the rf multipole ion guide 84 into a time-of-flight mass spectrometer 54. The ions go straight and are delivered into an ion acceleration volume defined between a repeller electrode 50 and an ion acceleration electrode 51. By the voltage application to the repeller electrode 50 for an extremely short time (of psec=$10^{-12}$ sec), the product ions are deflected toward the acceleration electrode 51. The product ions are accelerated all at once by the high voltage applied to the acceleration electrode, so that they fly in the TOF-MS space 54. The product ions fly as a parallel ion beam and enter a reflectron 52 arranged on the opposite side of the ion acceleration electrode 51. The reflectron 52 has a multi-layered structure of a plurality of electrodes to establish a gradient potential therein. A voltage higher than the acceleration voltage is applied to the electrode at the bottom of the reflectron 52. Therefore, the product ions having entered the reflectron 52 are repelled in the reflectron 52 so that they fly again in the TOF-MS space 54. The product ions reach a multi-channel plate (MCP) 53 so that they are detected.

The time period t from the ion acceleration start to the arrival at the multi-channel plate detector 53 is proportional to the root of the mass m so that the TOF-MS can acquire the mass spectrum.

In the present embodiment, the product ions having reduced the charges are detected by the multi-channel plate detector 53 of the TOF-MS space 54 so that the mass spectrum is obtained in the data processor 19. The TOF-MS has no upper limit to the measurement range on principle, so that it is remarkably advantageous for measuring biological high molecules having very large molecular weights.

Unlike the cases of Embodiments 1 to 4, moreover, the present embodiment need not to have the repeller electrode 57, to which there is applied the negative potential for preventing the negative ions from entering into the multi-channel plate detector 53. This is because the negative ions having emanated from the rf multipole ion guide 84 are removed by the positive potential applied to the repeller electrode 50. On the other hand, the positive ions are accelerated in the ion acceleration volume so that they can reach the multi-channel plate detector 53.

Embodiment 5

Figure 10:
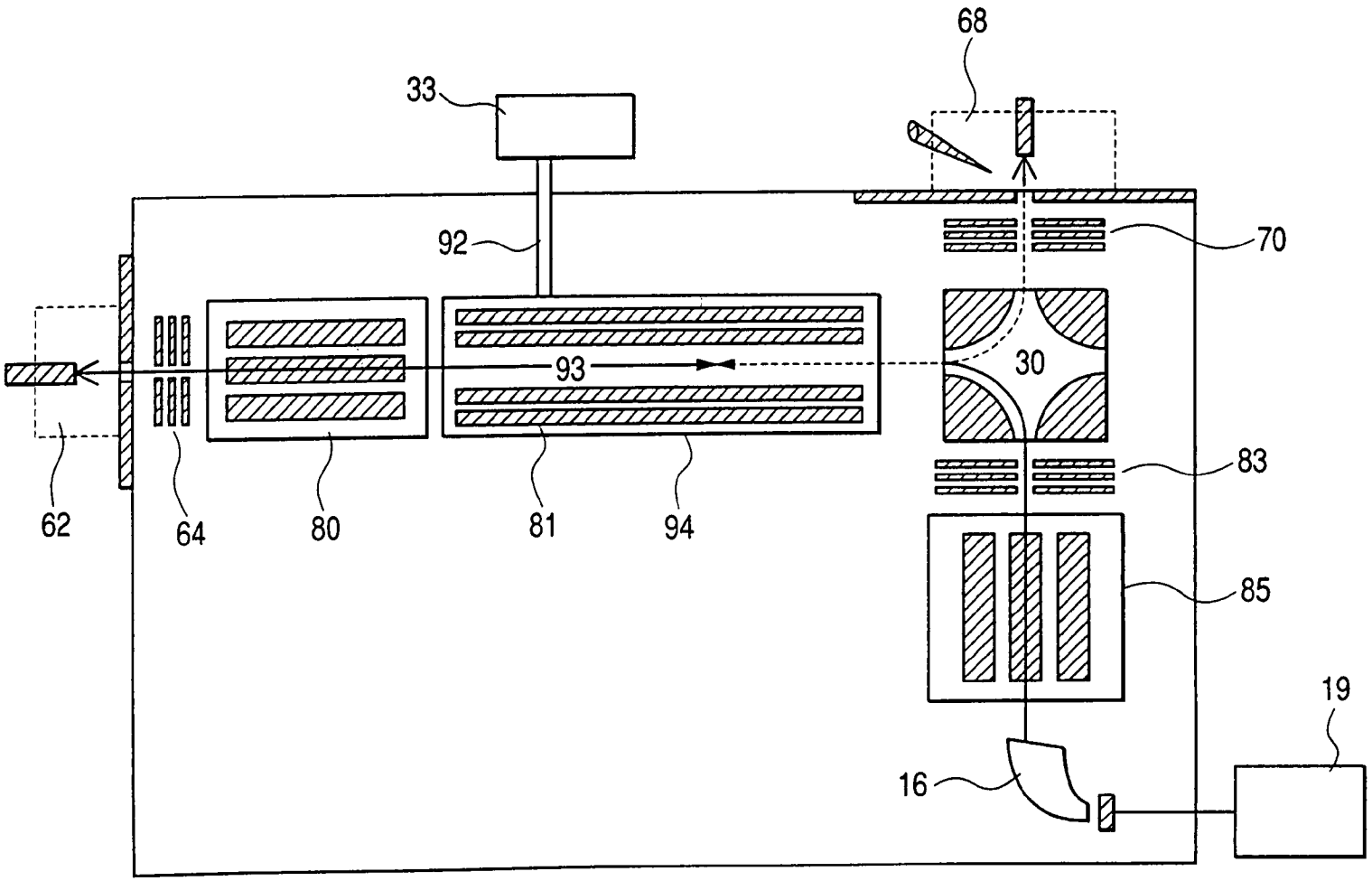
FIG. 10 is a schematic construction diagram of Embodiment 5.

FIG. 10 shows another embodiment. This example is provided with two QMS like Embodiment 3. In Embodiment 3, however, the positive product ions and the negative reactant ions are simultaneously introduced in the same direction into the rf multipole ion guide 84 so that they react while flying in the same direction in the rf multipole ion guide 84. In the present embodiment, however, the position of the reactions between the positive multiply-charged ions and the negative reactant ions is different from that of Embodiment 3. In the present embodiment, more specifically, the positive multiply-charged ions and the negative reactant ions are separately introduced from upstream and downstream of the rf multipole ion guide so that they make the charge reduction reactions while flying to each other in the rf multipole ion guide.

The positive multiply-charged ions produced in the ESI ion source 62 are introduced into the vacuum volume of the mass spectrometer system so that they are focused in the lens 64. The ions are then introduced into the first quadrupole mass spectrometer (QMS) 80 so that the precursor ions are isolated. The precursor ions isolated are then introduced into the lefthand side of the rf multipole ion guide 81. The Ar gas is introduced at a pressure of 1 mTorr ($10^{-3}$ Torr) from the gas reservoir 33 via a pipe 92' into the rf multipole ion guide 81. The precursor ions introduced collide, while progressing in the rf multipole ion guide 81, against the Ar molecules so that they are excited. Finally, the precursor ions are dissociated to give the produce ions. The negative reactant ions are produced in the APCI ion source 68 and are introduced into the vacuum region of the mass spectrometer system. The negative reactant ions are focused by the lens 70' and introduced into the electrostatic quadrupole deflector 30 so that they are deflected clockwise by 90 degrees. The negative reactant ions enter the rf multipole ion guide 81 from the righthand side and collide against the product ions coming from the lefthand side, so that they cause the charge reduction reactions. The product ions having reduced the charges in the rf multipole ion guide 81 are introduced into the electrostatic quadrupole deflector 30 so that they are deflected clockwise by 90 degrees. The product ions are introduced into the second quadrupole mass spectrometer 85 for the mass spectrometry. The product ions are detected according to mass by the detector 16 so that they give the mass spectrum in the data processor 19.

In the present embodiment, as shown in FIG. 10, the ion dissociations and the charge reduction reactions of ions can be done in the single rf multipole ion guide 81.

Figure 11:
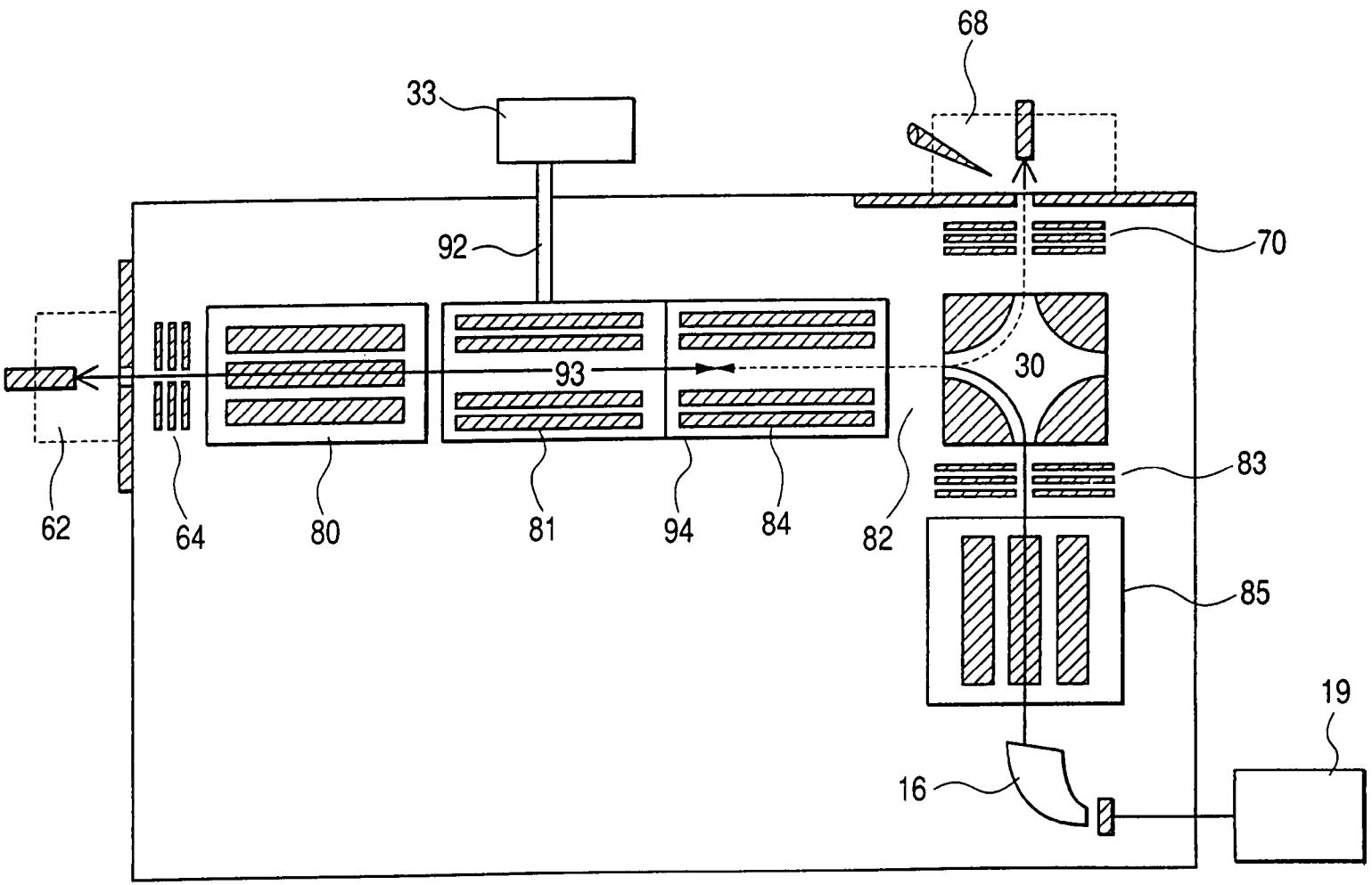
FIG. 11 is a schematic construction diagram of Embodiment 5.

As shown in FIG. 11, moreover, two rf multipole ion guides may be so arranged in tandem that the precursor ions are dissociated in the rf multipole ion guide 81 at the front stage and that the charge reduction reactions are made in the rf multipole ion guide 84 at the next stage. In the case of FIG. 11, the shielding cylinder 94 and the introduction of the buffer gas can be made common.

Figure 12:
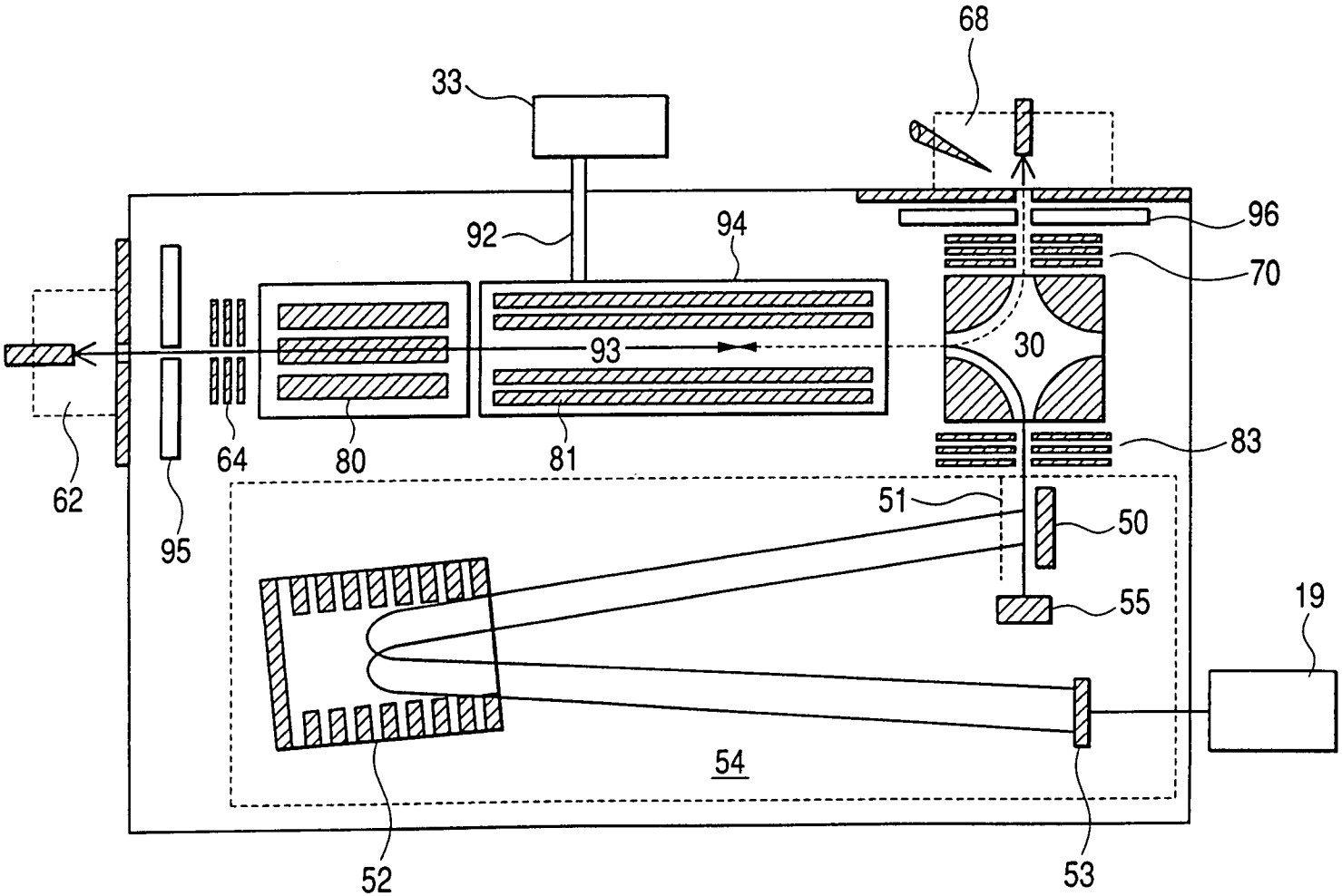
FIG. 12 is a schematic construction diagram of Embodiment 5.

FIG. 12 shows a modification of the present embodiment. Here is shown the case in which the mass spectrometer of FIG. 10 is replaced by the time-of-flight mass spectrometer (TOF-MS).

The behaviors of ions before introduced into the TOF-MS are similar to those of the case of FIG. 9. The product ions introduced into the TOF-MS are accelerated to start their flights by the potentials applied to the repeller electrode 50 and the ion acceleration electrode 51. The product ions are reflected at the reflectron 52 and are detected by the multi-channel plate detector 53 so that the mass spectrum is given by the data processor 19.

In the example of FIG. 12, too, the ion dissociations and the charge reduction reactions of ions can be done in the single rf multipole ion guide 81. As shown in FIG. 11, moreover, the two rf multipole ion guides may be so arranged in tandem that the precursor ions are dissociated in the rf multipole ion guide at the front stage and that the charge reduction reactions are made in the rf multipole ion guide at the next stage.

The present embodiment is advantageous over the Embodiments 3 and 4 in that the rf multipole ion guide 81 and the buffer gas introduction mechanism are simplified. In the present embodiment, moreover, the unreacted negative ions at the ion/ion reactions fly in the opposite direction (from right to left of FIG. 12) of the positive ions in the rf multipole ion guide 81 so that they do not enter the detector 16. Therefore, the electrode 57 and the power supply 56 are disused for repelling the negative ions.

Although the present invention has been described in detail in connection with its embodiments, its ion source for producing the multiply-charged ions of a sample should not be limited to the ESI ion source but can be applied to a sonic spray ion source (SSI), a nano-spray ion source, ion-spray ion source or a matrix-assisted laser desorption ion source. As the ion source for the reactant ions, on the other hand, it is possible to use not only the APCI ion source but also a glow discharge ionization (GDI) ion source, a chemical ionization (CI) ion source or an electron ionization (EI) ion source. The ion mode may be so set that the sample ions and the reactant ions are reversed in polarity from each other.

According to the present invention, the reactant ions can be sufficiently supplied even in the ion-trap mass spectrometry, thereby to improve the charge reduction efficiency due to the ion/ion reactions.

Moreover, the ion/ion reactions can be applied even to the quadrupole mass spectrometer or the time-of-flight mass spectrometer so that the mass peaks derived from the multiply-charged ions of the logical high molecules can be simplified to facilitate the mass spectral analyses.

According to the sample, moreover, the positive and negative polarities and the reactant ion species can be easily switched in response to the instruction from the data processor thereby to increase the information of the sample.

What is claimed is:

1. A mass spectrometer system for mass analysis of a sample to be measured, by ionizing the sample, comprising:

a first ion source for ionizing the sample;

a second ion source for producing ions of a polarity reversed from that of the ions produced in said first ion source;

an ion deflector for introducing and deflecting the ions of said first and second ion sources;

an ion-trap mass spectrometer including a ring electrode and a pair of endcap electrodes;

a detector for detecting ions ejected from said ion-trap mass spectrometer;

a first gate electrode arranged between said first ion source and said ion deflector; and a second gate electrode arranged between said second ion source and said ion deflector, wherein voltage applied to the first and second gate electrodes is controlled to adjust an amount of ions led from said first and second ion sources to said ion-trap mass spectrometer through said ion deflector, the ions from said first and second ion sources being mixed in said ion-trap mass spectrometer and detected in said detector.

2. A mass spectrometer system for mass analysis of a sample to be measured, by ionizing the sample, comprising:

a first ion source for ionizing the sample;

a second ion source for producing ions of a polarity reversed from that of the ions produced in said first ion source;

an ion deflector for introducing and deflecting the ions of said first and second ion sources;

an ion-trap mass spectrometer including a ring electrode and a pair of endcap electrodes;

a detector for detecting ions ejected from said ion-trap mass spectrometer;

a first lens electrode arranged between said first ion source and said ion deflector; and a second lens electrode arranged between said second ion source and said ion deflector, wherein voltage applied to the first and second lens electrodes is controlled to adjust an amount of ions led from said first and second ion sources to said ion-trap mass spectrometer through said ion deflector, the ions from said first and second ion sources being mixed in said ion-trap mass spectrometer and detected in said detector.

3. A mass spectrometer system for mass analysis of a sample to be measured, by ionizing the sample, comprising:

a first ion source for ionizing the sample;

a second ion source for producing ions of a polarity reversed from that of the ions produced in said first ion source;

an ion deflector for introducing and deflecting the ions of said first and second ion sources;

an ion-trap mass spectrometer including a ring electrode and a pair of endcap electrodes;

a detector for detecting ions ejected from said ion-trap mass spectrometer, wherein:

a sample ion produced by said first ion source is introduced in said ion-trap mass spectrometer, a reactant ion produced by said second ion source is introduced into said ion-trap mass spectrometer after isolating a specific ion, said sample ion and said reactant ion perform an ion/ion reaction in said ion-trap mass spectrometer, and an ion obtained after the ion/ion reaction is detected in said detector.

4. A mass spectrometer system for mass analysis of a sample to be measured, by ionizing the sample, comprising:

a first ion source for ionizing the sample;

a second ion source for producing ions of a polarity reversed from that of the ions produced in said first ion source;

an ion deflector for introducing and deflecting the ions of said first and second ion sources;

a quadrupole mass spectrometer for mass analysis of sample ions coming from said first ion source;

an RF multi-pole ion guide for producing product ions of the sample ions ejected from said quadrupole mass spectrometer, an ion deflector deflecting reactant ions coming from second ion source, and introducing the ions for said RF multi-pole ion guide;

a mass spectrometer for mass analysis of ions coming from said RF multi-pole ion guide through said ion deflector;

a detector for detecting ions ejected from said mass spectrometer, wherein:

an ion ejected from said first ion source is introduced in said RF multi-pole ion guide inside from one end of said RF multi-pole ion guide;

an ion ejected from said second ion source is introduced in said RF multi-pole ion guide inside from another end of said RF multi-pole ion guide;

said product ion and said reactant ion perform an ion/ion reaction in said RF multi-pole ion guide, and an ion after the ion/ion reaction is introduced in said mass spectrometer.

* * * * *